US006817346B2

(12) United States Patent
Konishi et al.

(10) Patent No.: US 6,817,346 B2
(45) Date of Patent: Nov. 16, 2004

(54) EVAPORATED FUEL PROCESSING APPARATUS FOR INTERNAL COMBUSTION ENGINE AND METHOD

(75) Inventors: Masaaki Konishi, Susono (JP); Junji Kato, Aichi-ken (JP); Kazuyuki Yada, Urayasu (JP); Yoshikazu Namura, Urayasu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/622,447

(22) Filed: Jul. 21, 2003

(65) Prior Publication Data

US 2004/0129257 A1 Jul. 8, 2004

(30) Foreign Application Priority Data

Jul. 24, 2002 (JP) ..... 2002-215391

(51) Int. Cl.[7] ..... F02M 25/08
(52) U.S. Cl. ..... 123/519; 123/520
(58) Field of Search ..... 123/516, 518–520

(56) References Cited

U.S. PATENT DOCUMENTS 4,116,184 A * 9/1978 Tomita ..... 123/438
4,962,744 A * 10/1990 Uranishi et al. ..... 123/520
5,099,439 A * 3/1992 Saito ..... 701/31
5,113,834 A * 5/1992 Aramaki ..... 123/520
5,150,689 A * 9/1992 Yano et al. ..... 123/519
5,251,592 A * 10/1993 Seki et al. ..... 123/198 D
5,429,098 A * 7/1995 Tomisawa ..... 123/520
5,873,352 A * 2/1999 Kidokoro et al. ..... 123/520

FOREIGN PATENT DOCUMENTS

| | | |
|---|---|---|
| JP | A 1-190955 | 8/1989 |
| JP | A 6-93932 | 4/1994 |
| JP | A 8-28370 | 1/1996 |

* cited by examiner

*Primary Examiner*—Thomas Moulis
(74) *Attorney, Agent, or Firm*—Oliff & Berridge, PLC

(57) ABSTRACT

In an evaporated fuel processing apparatus, a fuel tank is communicated with a canister via a vapor passage. A canister temperature sensor is disposed around a purge port of the canister for detecting a temperature of the canister. When a large quantity of gas is supplied upon supply of the fuel to flow from the fuel tank to the canister, the peak value of the canister temperature is detected. The fuel adsorbing state within the canister is estimated on the basis of the canister temperature obtained subsequent to detection of the peak value.

26 Claims, 12 Drawing Sheets

PRESSURE : Pout
TEMPERATURE : Tout
CROSS SECTIONAL AREA : Ao

PRESSURE : Pin
TEMPERATURE : Tin
CROSS SECTIONAL AREA : Aval

FROM TANK TO CANISTER

PRESSURE : Pin
TEMPERATURE : Tin
CROSS SECTIONAL AREA : Aval

PRESSURE : Pout
TEMPERATURE : Tout
CROSS SECTIONAL AREA : Ao

FROM CANISTER TO TANK

FIG. 10D $$m = Cd \frac{Pin}{\sqrt{RTin}} Aval \left(\frac{Pout}{Pin}\right)^{\frac{1}{r}} \sqrt{\frac{2r}{r-1}\left\{1-\left(\frac{Pout}{Pin}\right)^{\frac{r-1}{r}}\right\}}$$

Cd : FLOW RATE COEFFICIENT(COMPRESSIBILTY)
r : RATIO OF SPECIFIC HEAT
R : GAS CONSTANT
m : MASS FLOW RATE
Aval : AREA OF IN-TANK CONTROL VALVE OPENING

EVAPORATED FUEL PROCESSING APPARATUS FOR INTERNAL COMBUSTION ENGINE AND METHOD

INCORPORATION BY REFERENCE

The disclosure of Japanese Patent Application No.2002-215391 filed on Jul. 24, 2002, including the specification, drawings and abstract are incorporated herein by reference in its entirety.

BACKGROUND OF THE INVENTION

1. Field of Invention

The invention relates to an evaporated fuel processing apparatus for an internal combustion engine, and more particularly to an evaporated fuel processing apparatus suitable for effectively prevent the evaporated fuel generated in a fuel tank from being released to atmosphere.

2. Description of Related Art

There is disclosed an apparatus for processing evaporated fuel or fuel vapor generated within a fuel tank using a canister that adsorbs the fuel vapor so as not to be released to atmosphere, for example, in JP-A-6-93932. In such a generally employed fuel vapor processing apparatus, the intake negative pressure is introduced into the canister during operation of the internal combustion engine such that the fuel adsorbed in the canister is purged with air into an intake passage. This makes it possible to restore the fuel adsorbing capability of the canister without releasing the fuel into atmosphere during operation of the internal combustion engine.

In the aforementioned fuel vapor processing apparatus, quantity of injected fuel is adjusted so as to offset the quantity for purging. This allows the fuel in the canister to be purged into the internal combustion engine without varying the air/fuel ratio of the internal combustion engine.

In order to correct the fuel injection quantity accurately upon purging of the fuel in the canister into the intake passage, it is necessary to accurately detect the quantity of the fuel supplied through purging. Accordingly it is preferable to detect the fuel adsorbing state in the canister appropriately so as to accurately detect the quantity of the fuel supplied through purging.

The aforementioned apparatus is structured to monitor the temperature inside the canister and the temperature change is time integrated, based on which the fuel adsorbing state of the canister is estimated. Adsorption of the fuel vapor in the canister may cause an exothermic reaction. On the contrary, desorption of the fuel from the canister may cause an endothermic reaction. The temperature inside the canister, therefore, varies as the fuel is adsorbed in or released from the canister. The time integral value of the inner temperature is correlated with the residual state of the fuel in the canister. In the aforementioned apparatus, the fuel adsorbing state in the canister can be estimated with accuracy to a certain degree.

The change in the temperature inside the canister depends on the increase or decrease in the fuel adsorbed in the canister. The time integration of the temperature change may be effective for detecting the relative change in the quantity of the fuel in the canister. The absolute quantity of the fuel adsorbed in the canister, however, cannot be obtained by the aforementioned apparatus.

It is necessary to detect the absolute quantity of the fuel adsorbed in the canister for accurately detecting the quantity of the fuel supplied through purging. The detection of the fuel adsorbing state of the canister performed in the aforementioned apparatus, thus, is not sufficient to allow accurate correction of the fuel injection quantity.

SUMMARY OF THE INVENTION

It is an object of the invention to provide an evaporated fuel processing apparatus capable of detecting an absolute quantity of the fuel adsorbed in the canister accurately.

According to an embodiment of the invention, an evaporated fuel processing apparatus for an internal combustion engine includes a canister that adsorbs a fuel vapor generated within a fuel tank, a gas flow detecting mechanism that detects a flow of gas at least at a predetermined flow rate between the fuel tank and the canister. The predetermined flow rate is higher than a flow rate of gas normally flowing between the fuel tank and the canister which are communicated with each other. The apparatus further includes a canister temperature detector that detects a temperature of the canister, and a controller that detects one of an upper peak value and a lower peak value of the temperature of the canister caused in a continual state of the flow of gas at least at the predetermined flow rate detected by the gas flow detecting mechanism, and estimates a fuel adsorbing state within the canister on the basis of the canister temperature obtained subsequent to a detection of the one of the upper peak value and the lower peak value. According to an embodiment of the invention, the peak value of the canister temperature is detected in the condition where a large quantity of gas flows between the fuel tank and the canister. In the case where the fuel is adsorbed, the canister temperature reaches the peak temperature at a time when the canister no longer adsorbs the fuel. Meanwhile in the case where the fuel is desorbed, the canister temperature reaches the peak temperature at a time when the canister no longer desorbs the fuel. In the aforementioned cases, the absolute quantity of the fuel adsorbed in the canister is determined in accordance with the canister temperature, that is, the canister peak temperature. Accordingly, the fuel adsorbing state corresponding to the absolute quantity of the adsorbed fuel may be accurately estimated on the basis of the canister temperature subsequent to the peak temperature.

In the embodiment, the canister includes a purge port communicated with an intake passage of the internal combustion engine, and the canister temperature detector comprises a canister temperature sensor disposed around the purge port such that a temperature within the canister is detected. According to the embodiment, the canister temperature is detected around the purge port of the canister. The fuel adsorbing state around the purge port can be particularly detected with high accuracy. After the start of purging of the fuel, the fuel vapor concentration of the gas to be first purged is greatly influenced by the fuel adsorbing state of the canister around the purge port. If the fuel adsorbing state around the purge port can be accurately detected, the fuel vapor concentration of the purge gas may be accurately estimated immediately after the start of purging. This makes it possible to generate a large quantity of fuel to be purged.

In the embodiment, the controller obtains a fuel vapor concentration of the gas flowing between the fuel tank and the canister in the continual state of the flow of gas at least at the predetermined flow rate, and a flow rate of the gas flowing between the fuel tank and the canister in the continual state of the flow of gas at least at the predetermined flow rate. The controller further estimates the fuel adsorbing state on the basis of the canister temperature obtained subsequent to the detection of the one of the upper peak value and the lower peak value, the fuel vapor concentration, and the flow rate of the gas. According to the embodiment, the fuel adsorbing state can be estimated on the basis of the fuel vapor concentration of the gas that flows between the fuel tank and the canister, and the flow rate of the gas in addition to the canister temperature after reaching the peak temperature. This makes it possible to accurately estimate the fuel adsorbing state of the canister.

In the embodiment, the controller contains a map that stores the fuel adsorbing state within the canister defined by the canister temperature, the fuel vapor concentration, and the flow rate of the gas. The controller refers to the map so as to determine the fuel adsorbing state in accordance with the canister temperature obtained subsequent to the detection of the one of the upper peak value and the lower peak value, the fuel vapor concentration, and the flow rate of the gas. According to the embodiment, the fuel adsorbing state of the canister can be simply and yet accurately estimated by referring to the map of the fuel adsorbing state of the canister, which is defined by the canister temperature, fuel vapor concentration, and the flow rate of the gas.

In the embodiment, the gas flow detecting mechanism detects a flow of gas containing fuel vapor at least at the predetermined flow rate from the fuel tank to the canister upon a fuel supply. According to the embodiment, the fuel adsorbing state of the canister may be accurately estimated on the basis of the flow of a large quantity of the gas containing the fuel vapor in the direction from the fuel tank to the canister during the fuel supply.

In the embodiment, a tank vapor temperature detector that detects a vapor temperature within the fuel tank is provided. The controller obtains a saturated vapor pressure of a fuel vapor within the fuel tank on the basis of the vapor temperature, and further obtains a concentration of the fuel vapor on the basis of a ratio of the saturated vapor pressure to an atmospheric pressure. According to the embodiment, the fuel vapor concentration is obtained in the condition where the pressure within the fuel tank is held substantially equal to the atmospheric pressure during the fuel supply. In this case, the saturated vapor pressure of the fuel vapor is calculated on the basis of the vapor temperature. The fuel vapor concentration is accurately obtained on the basis of the saturated vapor pressure and the ratio of the saturated vapor pressure to the atmospheric pressure.

In the embodiment, a space capacity detector that detects a space capacity of the fuel tank is provided. The controller obtains a flow rate of the gas on the basis of a change in the space capacity detected by the space capacity detector as an elapse of time. According to the embodiment, the flow rate of the gas is obtained in the condition where the fluid level of the fuel tank rises as the supply of the fuel, and the space capacity of the fuel tank is accordingly decreased as time elapses from the fuel supply. In this case, the flow rate of the gas is calculated on the basis of the change in the space capacity as the elapse of time.

In an another embodiment of the invention, an in-tank control valve that controls communication between the fuel tank and the canister, and a differential pressure detector that detects a differential pressure generated between a side of the fuel tank and a side of the canister with respect to the in-tank control valve in a closed state are provided. The controller serves to open the in-tank control valve when the detected differential pressure is at least a predetermined valve opening pressure such that the gas flows at least at the predetermined flow rate between the fuel tank and the canister. According to the embodiment, when the differential pressure is generated between the fuel tank side and the canister side with respect to the in-tank pressure control valve, such in-tank pressure control valve is opened so as to allow a large quantity of the gas to flow between the fuel tank and the canister. In this case, the fuel adsorbing state of the canister may be estimated by causing a large quantity of the gas to flow.

In the embodiment, a tank vapor temperature detector that detects a vapor temperature within the fuel tank is provided. The controller obtains a saturated vapor pressure of a fuel vapor within the fuel tank on the basis of the tank vapor temperature, an inner pressure of the fuel tank, and a first fuel vapor concentration on the basis of a ratio of the saturated vapor pressure to the inner pressure of the fuel tank when the gas flows at least at the predetermined flow rate from the fuel tank to the canister. According to the embodiment, the saturated vapor pressure of the fuel vapor is calculated in the case where a large quantity of the gas flows from the fuel tank to the canister as the in-tank pressure control valve is opened. The fuel vapor concentration is accurately calculated on the basis of the ratio of the saturated vapor pressure to the in-tank pressure.

In the embodiment, the controller obtains a saturated vapor pressure of the fuel vapor within the canister on the basis of the canister temperature, and a second fuel vapor concentration on the basis of a ratio of the saturated vapor pressure to an atmospheric pressure when the gas flows at least at the predetermined flow rate from the canister to the fuel tank. According to the embodiment, the saturated vapor pressure of the fuel vapor in the canister is calculated on the basis of the canister temperature in the case where a large quantity of the gas flows from the canister to the fuel tank as the in-tank pressure control valve is opened. The fuel vapor concentration is accurately calculated on the basis of the ratio of the saturated vapor pressure to the atmospheric pressure.

In the embodiment, the controller obtains the inner pressure of the fuel tank, and a first flow rate of the gas that flows at least at the predetermined flow rate from the fuel tank to the canister using a formula: Formula:

$$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Pout as a pressure at an outflow side represents the inner pressure of the fuel tank, Tin as a temperature at an inflow side represents the canister temperature, Pin as a pressure at the inflow side represents the atmospheric pressure, Cd represents a flow rate coefficient indicating compressibility, r represents a ratio of the specific heat, R represents a gas constant, and Aval represents an opening area of the in-tank control valve. According to the embodiment, the flow rate m of a large quantity of the gas flowing from the fuel tank to the canister is obtained by substituting the vapor temperature in the fuel tank as the outflow temperature Tout, the inner pressure of the fuel tank as the outflow pressure Pout, the canister temperature as the inflow temperature Tin, and the atmospheric pressure as the inflow pressure Pin in a predetermined formula.

In the embodiment, the controller obtains the tank vapor temperature within the fuel tank, the inner pressure of the fuel tank, and a second flow rate of the gas that flows at least at the predetermined flow rate from the canister to the fuel tank using a formula: Formula:

$$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Pout as the pressure at the outflow side represents the atmospheric pressure, the Tin as the temperature at the inflow side represents the tank vapor temperature within the fuel tank, the Pin as the pressure at the inflow side represents the inner pressure of the fuel tank, Cd represents the flow rate coefficient indicating compressibility, r represents the ratio of the specific heat, R represents the gas constant, and Aval represents the opening area of the in-tank control valve. According to the embodiment, the flow rate m of a large quantity of the gas flowing from the canister to the fuel tank is obtained by substituting the canister temperature as the outflow temperature Tout, the atmospheric pressure as the outflow pressure Pout, the vapor temperature within the fuel tank as the inflow temperature Tin, and the inner pressure of the fuel tank as the inflow pressure Pin in a predetermined formula.

In the embodiment, the controller includes an in-tank pressure sensor for detecting the inner pressure of the fuel tank. According to the embodiment, the inner pressure of the fuel tank can be easily detected by the in-tank pressure sensor.

In another embodiment, a space capacity detector that detects a space capacity of the fuel tank is provided. The controller obtains the saturated vapor pressure of the fuel vapor within the fuel tank on the basis of the tank vapor temperature, and serves to block the fuel tank by closing the in-tank pressure control valve after the inner pressure of the fuel tank becomes the atmospheric pressure. The controller further obtains a total number of moles of the gas within the fuel tank on the basis of the space capacity, the vapor temperature, and the atmospheric pressure obtained when the fuel tank is blocked; a number of moles of air within the fuel tank on the basis of a ratio of the saturated vapor pressure to the atmospheric pressure and the total number of moles; a partial pressure of air within the fuel tank on the basis of the number of moles of air, the space capacity, and the vapor temperature obtained when a block state of the fuel tank is held; and an inner pressure of the fuel tank by adding the saturated vapor pressure to the partial pressure of air. According to the embodiment, the number of moles of air within the fuel tank can be calculated on the basis of the total number of moles of the gas within the fuel tank, the saturated vapor pressure of the fuel, the in-tank pressure (atmospheric pressure) at a time when the fuel tank is disconnected from the canister. Subsequently, the air partial pressure within the fuel tank may be obtained on the basis of the number of moles, and the space capacity and the vapor temperature at the respective time points. The inner pressure of the fuel tank may be obtained by adding the calculated air partial pressure to the saturated vapor pressure at that time.

BRIEF DESCRIPTION OF THE DRAWINGS

FIGS. 10A to 10D are views representing calculation of the flow rate of the gas that flows between the fuel tank and the canister according to the second embodiment;

DETAILED DESCRIPTION OF PREFERRED EMBODIMENTS

Figure 1:
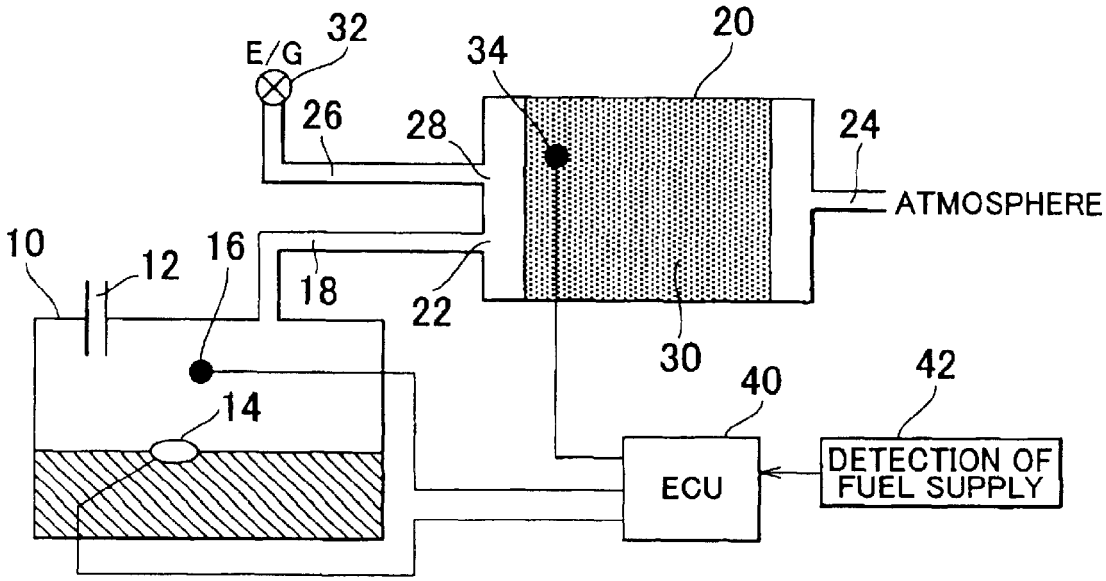
FIG. 1 is a schematic view of an evaporated fuel processing apparatus according to a first embodiment.

Embodiments of the invention will be described referring to the drawings. The same elements of those embodiments will be designated with the same reference numerals. The respective descriptions of those elements, thus, will be omitted.

First Embodiment

Structure of the Fuel Vapor Processing Apparatus

FIG. 1 is a schematic view of an evaporated fuel processing apparatus according to a first embodiment. Referring to FIG. 1, the evaporated fuel processing apparatus has a fuel tank 10 provided with an inlet 12. The inlet 12 is opened upon supply of the fuel. In this state, the inner pressure of the fuel tank 10 becomes substantially equal to an atmospheric pressure $P_o$.

A fluid level sensor 14 is provided within the fuel tank 10 so as to detect the fluid level of the fuel. A space capacity V within the fuel tank 10, that is, the capacity V occupied by the fuel vapor and air is defined by the fluid level of the fuel. Accordingly the space capacity V can be obtained on the basis of the output of the fluid level sensor 14.

A tank temperature sensor 16 is also provided within the fuel tank 10. The tank temperature sensor 16 detects the temperature of gas in the fuel tank 10, that is, the fuel vapor temperature, which will be referred to as a "tank vapor temperature Tvap".

The fuel tank 10 is communicated with a canister 20 via a vapor passage 18. The canister 20 includes a vapor port 22 connected to the vapor passage 18, an atmosphere port 24 through which atmosphere is introduced, and a purge port 28 communicated with a purge passage 26 to be described later. The canister 20 is filled with active carbon 30 by which the fuel vapor flowing through the vapor port 22 is adsorbed. Referring to FIG. 1, the vapor port 22 and the purge port 28 are provided on the same side of the canister 20 with respect to the active carbons 30. Meanwhile, the atmosphere port 24 is provided on the side opposite to the ports 22, 28 with respect to the active carbons 30.

The purge passage 26 is communicated with an intake passage (not shown) of the internal combustion engine. A purge VSV 32 is provided in the middle of the purge passage 26 for controlling the state of communication with the intake passage. During operation of the internal combustion engine, the intake negative pressure therein is introduced into the purge passage 26. When the purge VSV 32 is opened in the aforementioned state, the intake negative pressure reaches the purge port 28 of the canister 20. As a result, the air flow from the atmosphere port 24 to the purge port 28 is generated. This may cause the fuel adsorbed in the active carbon 30 to be released therefrom. The evaporated fuel processing apparatus makes it possible to purge the fuel adsorbed in the canister appropriately by opening the purge VSV 32 during operation of the internal combustion engine.

A canister temperature sensor 34 is provided in the vicinity of the purge port 28 in the canister 20. The canister temperature sensor 34 is capable of detecting the inner temperature of the canister 20 in the vicinity of the purge port 28.

Referring to FIG. 1, the evaporated fuel processing apparatus includes an ECU (Electronic Control Unit) 40 that receives inputs of signals output from the fluid level sensor 14, the tank temperature sensor 16, the canister temperature sensor 34, and a fuel supply detection mechanism 42.

The fuel supply detection mechanism 42 detects execution of the fuel supply irrespective of ON/OFF state of the ignition switch of the internal combustion engine. The fuel supply detection mechanism 42 may be formed as a switch that detects an operation of a lid opener, a switch that detects opening of the inlet 12, a mechanism that detects a sharp rise in the fluid level on the basis of signal output from the fluid level sensor 14 and the like. In this embodiment, the ECU 40 is structured to be operative for a predetermined period at least from the detection of the fuel supply irrespective of the ON/OFF state of the ignition switch.

Basic Operation of the Evaporated Fuel Processing Apparatus

During running of the vehicle, or immediately after stop of the vehicle, the inner temperature of the fuel tank 10 is increased under the heat generated by the internal combustion engine. In this case, a large quantity of the fuel vapor is generated within the fuel tank 10. The canister 20 appropriately adsorbs the thus generated fuel vapor so as not to be released to atmosphere.

Upon supply of the fuel to the fuel tank 10, the fluid level rises, that is, the space capacity V is decreased. In the course of the decrease in the space capacity V, a large quantity of the fuel vapor within the fuel tank 10 flows therefrom. The evaporated fuel processing apparatus allows the canister 20 to appropriately adsorb the fuel vapor that flows outside the fuel tank 10 upon supply of the fuel. This makes it possible to effectively prevent the fuel vapor from being released to atmosphere upon supply of the fuel.

The ECU 40 serves to open the purge VSV32 during operation of the internal combustion engine such that the fuel adsorbed in the canister 20 is purged into the intake passage of the internal combustion engine. This allows the canister 20 to restore the fuel adsorbing ability without releasing the fuel into atmosphere during operation of the internal combustion engine.

The ECU 40 serves to decrease the quantity of the injected fuel so as to offset the quantity corresponding to the purged fuel upon purging of the fuel adsorbed in the canister 20 into the intake passage. In the evaporated fuel processing apparatus of this embodiment, the fuel in the canister 20 may be purged into the intake passage without causing fluctuation in the air/fuel ratio during operation of the internal combustion engine.

In the evaporated fuel processing apparatus of this embodiment, it is preferable to keep the fuel adsorbing capability of the canister 20 as much as possible so as to effectively prevent release of the fuel vapor into atmosphere. Accordingly, under the condition that allows purging of the fuel, the quantity of the purge gas directed to the intake passage from the canister 20 is required to be as large as possible.

It is necessary to correct the fuel injection quantity to offset the quantity of the fuel supplied by the purge gas in order to generate a large quantity of the purge gas without causing fluctuation in the air/fuel ratio. In order to accurately obtain the quantity of the fuel supplied by the purge gas, the fuel vapor concentration of the purge gas is required to be accurately detected. Accordingly a large quantity of the purge gas may be generated so long as the fuel vapor concentration of the purge gas is accurately detected.

It is well known that the fuel vapor concentration of the purge gas is detected on the basis of the variance in the air/fuel ratio upon start of purging, or using a vapor concentration sensor. The aforementioned technique is employed for detecting the fuel vapor concentration of the purge gas after the start of purging. Therefore, the aforementioned technique needs to prevent fluctuation in the air/fuel ratio for a predetermined period after the start of purging by decreasing the quantity of purging.

The ECU 40 in this embodiment has a function that accurately estimates the fuel adsorbing state corresponding to the absolute quantity of the fuel adsorbed in the canister 20 during the fuel supply. Assuming that the fuel adsorbing state of the canister 20 is accurately estimated during the fuel supply, the fuel vapor concentration immediately after the start of purging is predictable on the basis of the estimated fuel adsorbing state upon start of purging. This makes it possible to generate a large quantity of the purge gas from the start of purging. Accordingly, the evaporated fuel processing apparatus of this embodiment realizes a high purging capability.

Brief Description of Estimation of Fuel Adsorbing State

Figure 2:
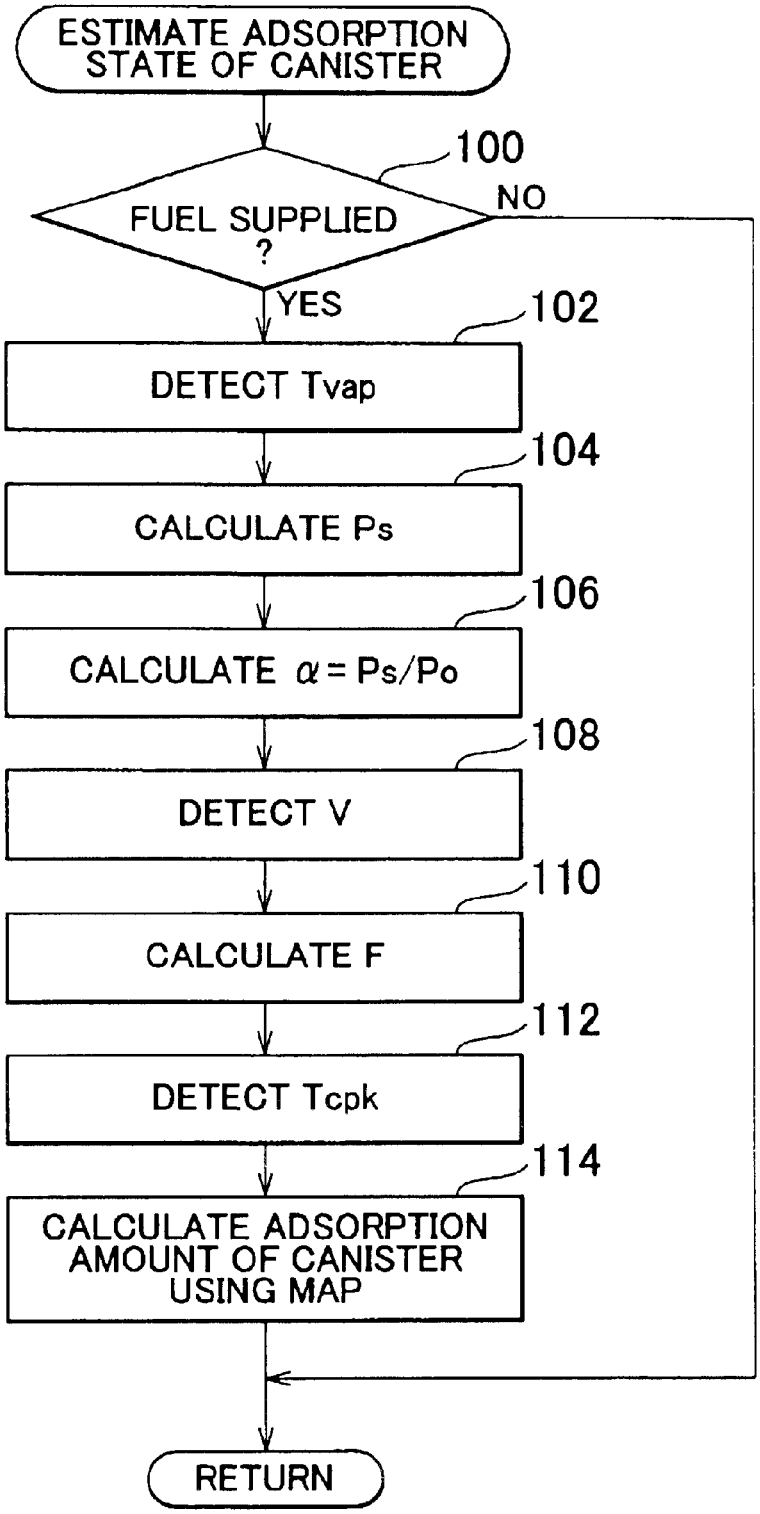
FIG. 2 is a flowchart of a control routine executed according to the first embodiment.

FIG. 2 is a flowchart of a control routine executed by the ECU 40 for estimating the fuel adsorbing state of the canister 20 during the fuel supply. Referring to the flowchart in FIG. 2, in step 100, it is determined whether the fuel supply is in operation.

If No is obtained in step 100, that is, the fuel supply is not in operation, the control routine ends. If Yes is obtained in step 100, that is, the fuel supply is in operation, the process proceeds to step 102 where the tank vapor temperature Tvap is detected on the basis of an output signal of the tank temperature sensor 16.

Then in step 104, a saturated vapor pressure Ps of the fuel vapor in the fuel tank 10 is obtained. The saturated vapor pressure Ps is uniquely defined by the temperature within the fuel tank 10, that is, the tank vapor temperature Tvap. The ECU 40 obtains the saturated vapor pressure Ps by referring to a map stored therein where a relationship between the saturated vapor pressure Ps and the tank vapor temperature Tvap is contained.

In step 106, a vapor concentration $\alpha$ within the fuel tank 10 is calculated. The inner pressure of the fuel tank 10 is approximately equal to an atmospheric pressure Po during the fuel supply. So the vapor concentration $\alpha$ may be calculated by obtaining a ratio of the saturated vapor pressure Ps to the atmospheric pressure Po, that is, Ps/Po.

In step 108, a space capacity V of the fuel tank 10 is detected on the basis of an output signal of the fluid level sensor 14. The process further proceeds to step 110 where the flow rate F of gas flowing from the fuel tank 10 to the canister 20 is calculated using the equation of F=dV/dt.

In step 112, a peak value of a canister temperature Tcan, that is, the canister peak temperature Tcpk is detected on the basis of an output signal of the canister temperature sensor 34. The mechanism of causing the canister temperature Tcan to reach the peak temperature Tcpk during the fuel supply or the reason for detecting the peak temperature Tcpk will be described later in detail.

In step 114, the fuel adsorbing state in the canister 20, more specifically, the fuel adsorbing state around the purge port 28 where the canister temperature sensor 34 is disposed is estimated in reference to the map stored in the ECU 40. The map contains the fuel adsorbing state of the canister 20 defined by the canister peak temperature Tcpk, the fuel vapor concentration α, and the flow rate F of the fuel vapor upon the flow of the fuel vapor directed to the canister 20. In step 114, the fuel adsorbing state in the canister 20 is estimated on the basis of the fuel vapor concentration α obtained in step 106, the flow rate F of the gas detected in step 110, and the canister peak temperature Tcpk detected in step 112.

Estimation of Quantity of Adsorbed Fuel

Figure 3:
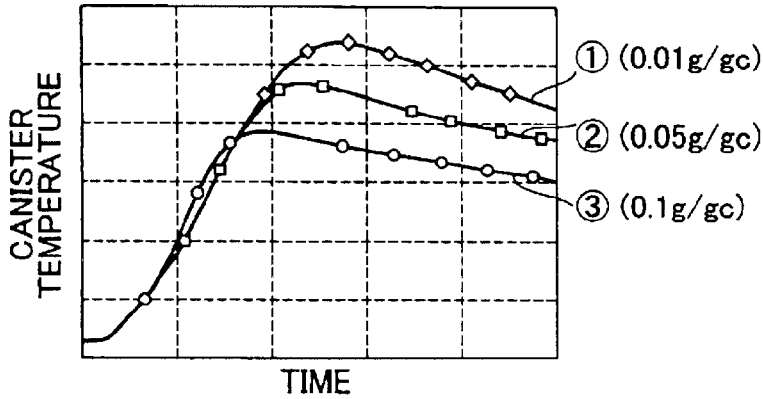
FIG. 3 is a graph representing a relationship between a peak temperature of the canister and an adsorption quantity at an initial stage upon introduction of gas.
Figure 4:
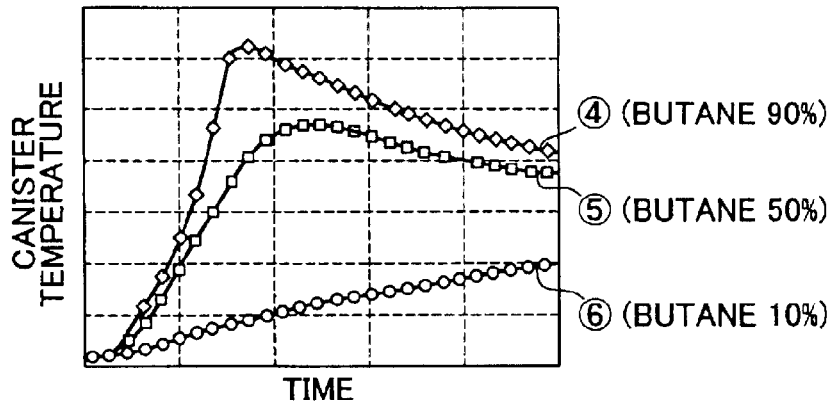
FIG. 4 is a graph representing a relationship between a peak temperature of the canister and a fuel vapor concentration of the gas upon introduction of the gas.
Figure 5:
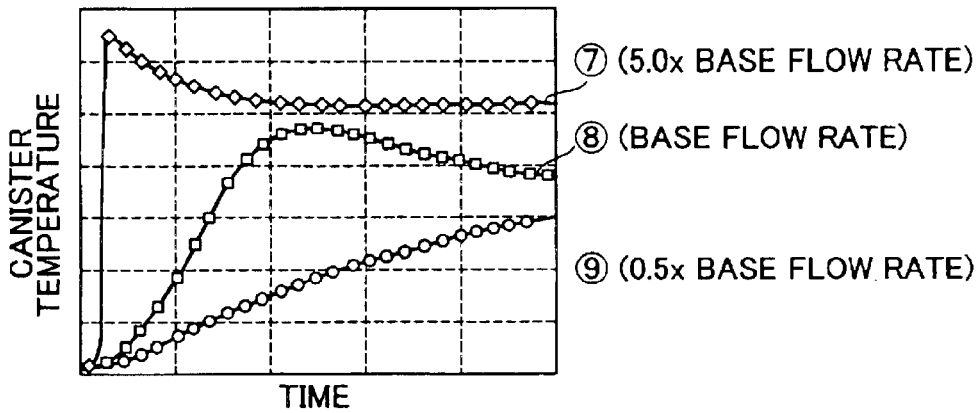
FIG. 5 is a graph representing a relationship between a peak temperature of the canister and a flow rate of the gas upon introduction of the gas.

Described referring to FIGS. 3 to 5 are the mechanism why the canister temperature reaches the peak temperature Tcpk during the fuel supply, and the peak temperature Tcpk should be detected, and how the fuel adsorbing state of the canister 20 is estimated in step 114 shown in the flowchart of FIG. 2 on the basis of the vapor concentration α, flow rate F of gas, and the peak temperature Tcpk.

In the state where the fuel vapor flows from the fuel tank 10 to the canister 20 during the fuel supply, the fuel vapor is adsorbed in the active carbon 30 until the fuel adsorbing quantity of the canister 20 reaches the saturated value under the environment. More specifically, in the state where the fuel vapor flows into the canister 20 during the fuel supply, the active carbon 30 around the vapor port 22, and accordingly the purge port 28, serves to adsorb the fuel vapor until it becomes saturated. As the fuel vapor continuously flows, the area of the active carbon 30 that has adsorbed the fuel vapor until saturation expands toward the atmosphere port 24.

Adsorbing of the fuel vapor performed by the active carbon 30 causes the exothermic reaction. As a result, the canister temperature Tcan detected by the canister temperature sensor 34 rises so long as the active carbon 30 around the purge port 28 adsorbs the fuel vapor. If the active carbon 30 around the purge port 28 becomes saturated, and the fuel is no longer adsorbed, the canister Tcan begins dropping owing to the cooling effect caused by passage of the gas. Therefore, the canister temperature Tcan reaches the upper peak temperature Tcpk at a time when the active carbon 30 around the purge port 28 is saturated.

FIG. 3 is a graph representing each of the canister peak temperatures Tcpk as described above. Referring to the graph of FIG. 3, the curve ① is obtained in the condition where 0.01 g of the fuel is preliminarily adsorbed in the active carbon 30 per gram as an initial adsorbing quantity. The curve ② is obtained in the condition where 0.05 g of the fuel is preliminarily adsorbed in the active carbon 30 per gram as the initial adsorbing quantity. The curve ③ is obtained in the condition where 0.1 g of the fuel is preliminarily adsorbed in the active carbon 30 per gram as the initial adsorbing quantity.

The smaller the initial quantity of the active carbon 30 becomes before the fuel supply, the larger the quantity of the fuel vapor adsorbed in the active carbon 30 becomes upon the fuel supply. The larger the quantity of the fuel vapor becomes upon the fuel supply, the higher the canister peak temperature Tcpk becomes. As those curves ①, ②, ③ show, the canister peak temperature Tcpk becomes higher as the initial adsorbing quantity becomes smaller.

If the canister peak temperature Tcpk is detected during the fuel supply, it is determined that the active carbon 30 around the purge port 28 has become saturated. The absolute quantity of the fuel that can be adsorbed in the active carbon 30 in the saturated state becomes small as the temperature of the active carbon 30 rises. In the case where the active carbon 30 around the purge port 28 is saturated, the quantity of the fuel in terms of the absolute quantity that has been adsorbed in the active carbon 30 so far may be obtained on the basis of the thus detected canister peak temperature Tcpk.

The temperature of the active carbon 30 around the purge port 28, that is, the canister temperature Tcan detected by the canister temperature sensor 34 slightly drops during the fuel supply after the canister temperature Tcan reaches the peak temperature Tcpk. The absolute quantity of the fuel that has been adsorbed in the active carbon 30 slightly increases even after the canister temperature Tcan reaches the peak temperature Tcpk. As the temperature increase is negligible, the fuel adsorbing state obtained on the basis of the canister peak temperature Tcpk may be approximately used as being representative of the fuel adsorbing state upon completion of the fuel supply. That is why the canister peak temperature Tcpk is detected in step 112 of the flowchart shown in FIG. 2 so as to obtain the fuel absorbing state of the active carbon 30.

FIG. 4 is a graph representing each of the canister peak temperatures Tcpk with respect to the fuel vapor concentration of the gas flowing into the canister 20 from the fuel tank 10 during the fuel supply. Referring to FIG. 4, the curve ④ is obtained in the condition where the fuel vapor concentration (butaine concentration) is 90%. The curve ⑤ is obtained in the condition where the fuel vapor concentration is 50%. The curve ⑥ is obtained in the condition where the fuel vapor concentration is 10%.

The curves ④, ⑤, ⑥ respectively show that the higher the fuel vapor concentration of the gas flowing into the canister 20 becomes, the higher the canister peak temperature Tcpk becomes. As described before, the canister peak temperature Tcpk becomes higher as the quantity of the fuel adsorbed in the active carbon 30 increases during the fuel supply. Those curves ④, ⑤, ⑥ represent that, in the transitional state to saturation, the quantity of the fuel adsorbed in the active carbon 30 becomes large as the fuel vapor concentration of the gas flowing into the canister 20 becomes higher.

The above results show that the absolute quantity of the fuel adsorbed in the active carbon 30 becomes large as the fuel vapor concentration of the gas flowing into the canister 20 becomes higher in the state where the active carbon 30 around the purge port 28 is saturated during the fuel supply. The apparatus of this embodiment is structured to obtain the fuel adsorbing state in the active carbon 30 upon completion of the fuel supply on the basis of the fuel vapor concentration α of the gas flowing into the canister 20 during the fuel supply in step 114 of the control routine as shown in FIG. 2.

FIG. 5 is a graph showing each of the canister peak temperature Tcpk with respect to the flow rate of the gas (g/min) flowing into the canister 20 from the fuel tank 10 during the fuel supply. Referring to FIG. 5, the curve ⑧ is obtained in the condition where a basic flow rate of the gas flows. The curve ⑦ is obtained in the condition where the flow rate of the gas is increased five times the basic flow rate.

The curve ⑨ is obtained in the condition where the flow rate of the gas is half the basic flow rate.

Those curves ⑦, ⑧, ⑨ represent that the higher the flow rate of the gas flowing into the canister 20 becomes, the higher the canister peak temperature Tcpk becomes. Those results show that the absolute quantity of the fuel adsorbed in the active carbon 30 becomes large as the flow rate of the gas (instantaneous value) flowing into the canister 20 becomes higher in the case where the active carbon 30 around the purge port 28 is saturated in the course of the fuel supply. The apparatus of this embodiment is structured to obtain the fuel adsorbing state of the active carbon 30 upon completion of the fuel supply on the basis of the fuel vapor concentration $\alpha$ of the gas flowing into the canister 20 during the fuel supply in step 114 of the control routine as shown in FIG. 2.

Figure 6:
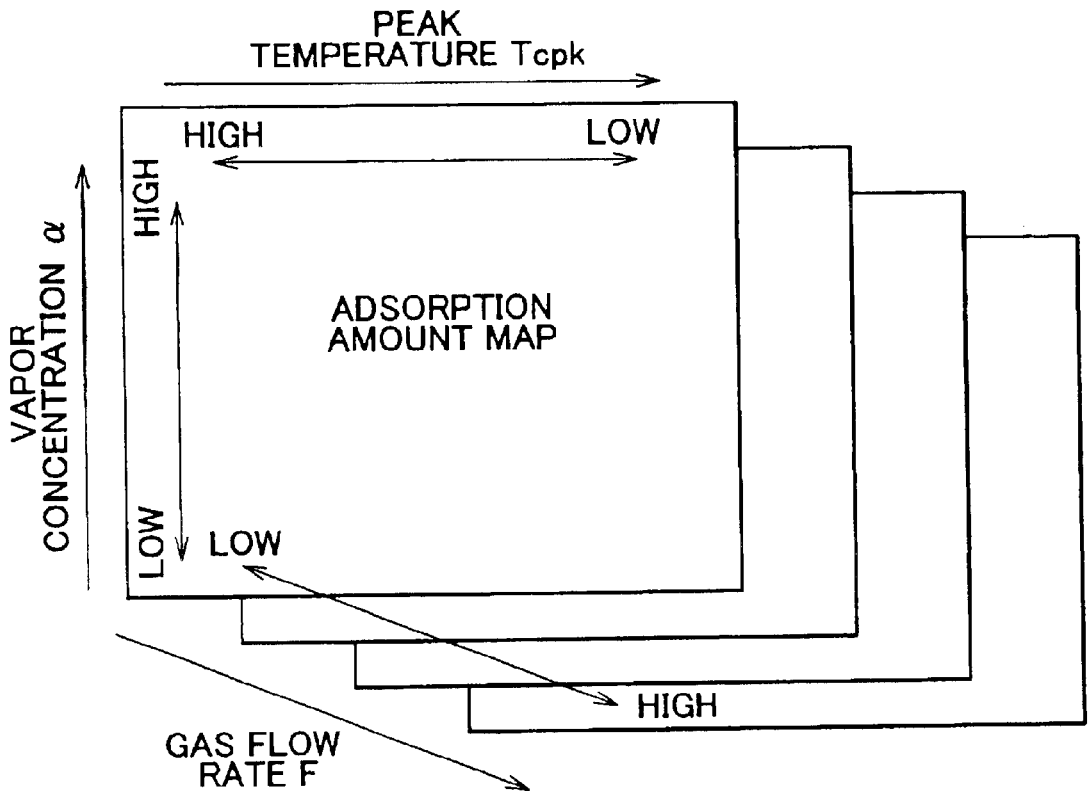
FIG. 6 is a map for estimating the fuel adsorbing state of the canister according to the first embodiment.

FIG. 6 is a schematic view of a fuel adsorbing quantity map stored in the ECU 40 in the embodiment. This map is referred by the ECU 40 for processing step 114 of the control routine shown in FIG. 2. In other words, this map is used for estimating the quantity of the fuel adsorbed in the active carbon 30 around the purge port 28 upon completion of the fuel supply as the absolute value. This map is three-dimensional showing the fuel adsorbing quantity defined by the canister peak temperature Tcpk, the fuel vapor concentration $\alpha$, and the flow rate F of the gas.

The map shown in FIG. 6 is experimentally determined so as to reflect the influence of the canister peak temperature Tcpk, the fuel vapor concentration $\alpha$, and the gas flow rate F on the fuel adsorbing quantity. Accordingly the quantity of the fuel adsorbed in the active carbon 30 around the purge port 28 can be accurately obtained as the absolute value if the fuel adsorbing quantity is estimated referring to the map shown in FIG. 6.

When purging of the fuel in the canister 20 starts upon completion of the fuel supply, the purge gas containing the fuel desorbed from the active carbon 30 around the purge port 28 is purged into the intake passage. The apparatus of the embodiment makes it possible to obtain the fuel adsorbing state of the active carbon 30 accurately before start of purging. Accordingly, the fuel vapor concentration of the purge gas to be purged immediately after start of purging is accurately estimated such that a large quantity of the purge gas is generated upon start of purging. This apparatus, thus, allows excellent fuel purging capability.

Modified Embodiment

In the aforementioned embodiment, the fuel adsorbing state of the canister 20 is estimated on the basis of the canister peak temperature Tcpk in the course of the fuel supply. However, the fuel adsorbing state may be estimated on the basis of the parameter other than the canister peak temperature Tcpk. More specifically, the fuel adsorbing state of the canister 20 may be estimated in the course of the fuel supply on the basis of the canister temperature Tcan detected after the peak temperature Tcpk.

In the first embodiment, the state where the fuel supply is performed represents the state where a large quantity of gas is supplied. The canister temperature sensor 34 is used to detect the temperature of the canister. The ECU 40 executes step 112 of the control routine shown in FIG. 2 where the canister peak temperature Tcpk is detected, and step 114 where the fuel adsorbing state is estimated.

In the first embodiment, the ECU 40 executes step 106 where the fuel vapor concentration is obtained, and step 110 where the gas flow rate is obtained.

In the first embodiment, the tank temperature sensor 16 is used for detecting the tank vapor temperature, and the ECU 40 executes step 104 where the in-tank saturated vapor pressure is obtained, and step 106 where the fuel vapor concentration is obtained.

In the first embodiment, the fluid level sensor 14 is used to detect the space capacity, and the ECU 40 executes step 110 where the gas flow rate is obtained.

Second Embodiment

Structure of Fuel Vapor Processing Apparatus

Figure 7:
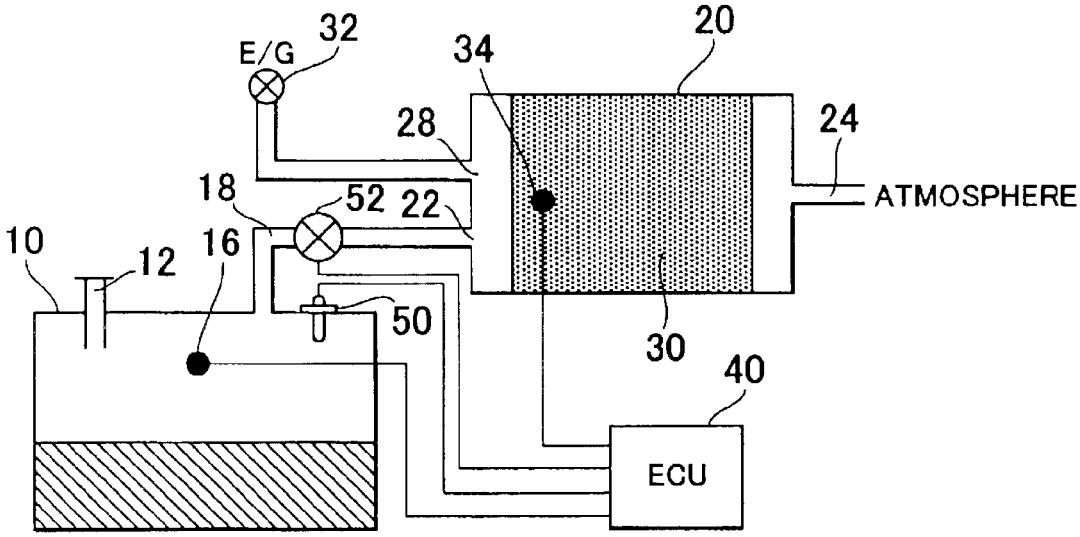
FIG. 7 is a schematic view of the evaporated fuel processing apparatus according to a second embodiment.

A second embodiment will be described referring to FIGS. 7 to 11. FIG. 7 is a schematic view of the evaporated fuel processing apparatus of the second embodiment. In FIG. 7, the same elements as those shown in FIG. 1 will be designated with the same reference numerals, and the description of those elements, thus, will be briefly described or omitted.

Referring to FIG. 7, the evaporated fuel processing apparatus of the second embodiment includes an in-tank pressure sensor 50 for detecting an inner pressure of the fuel tank 10, that is, an in-tank pressure Ptnk. An output signal of the in-tank pressure sensor 50 is sent to the ECU 40. The evaporated fuel processing apparatus also includes an in-tank pressure control valve 52 so as to control a communication state of the vapor passage 18 that connects between the fuel tank 10 and the canister 20. The in-tank pressure control valve 52 is controlled by the ECU 40 that allows selection of the communication state of the valve 52 between the open state and the closed state.

Operation of the Evaporated Fuel Processing Apparatus

In the evaporated fuel processing apparatus of the first embodiment, the fuel adsorbing state of the canister 20 is estimated upon the fuel supply under the condition of the saturated state of the active carbon 30 around the purge port 28 when a large quantity of gas flows from the fuel tank 10 to the canister 20. The apparatus of this embodiment has a function of creating such condition based on which the fuel adsorbing state of the canister 20 is estimated irrespective of execution of the fuel supply.

Figure 8:
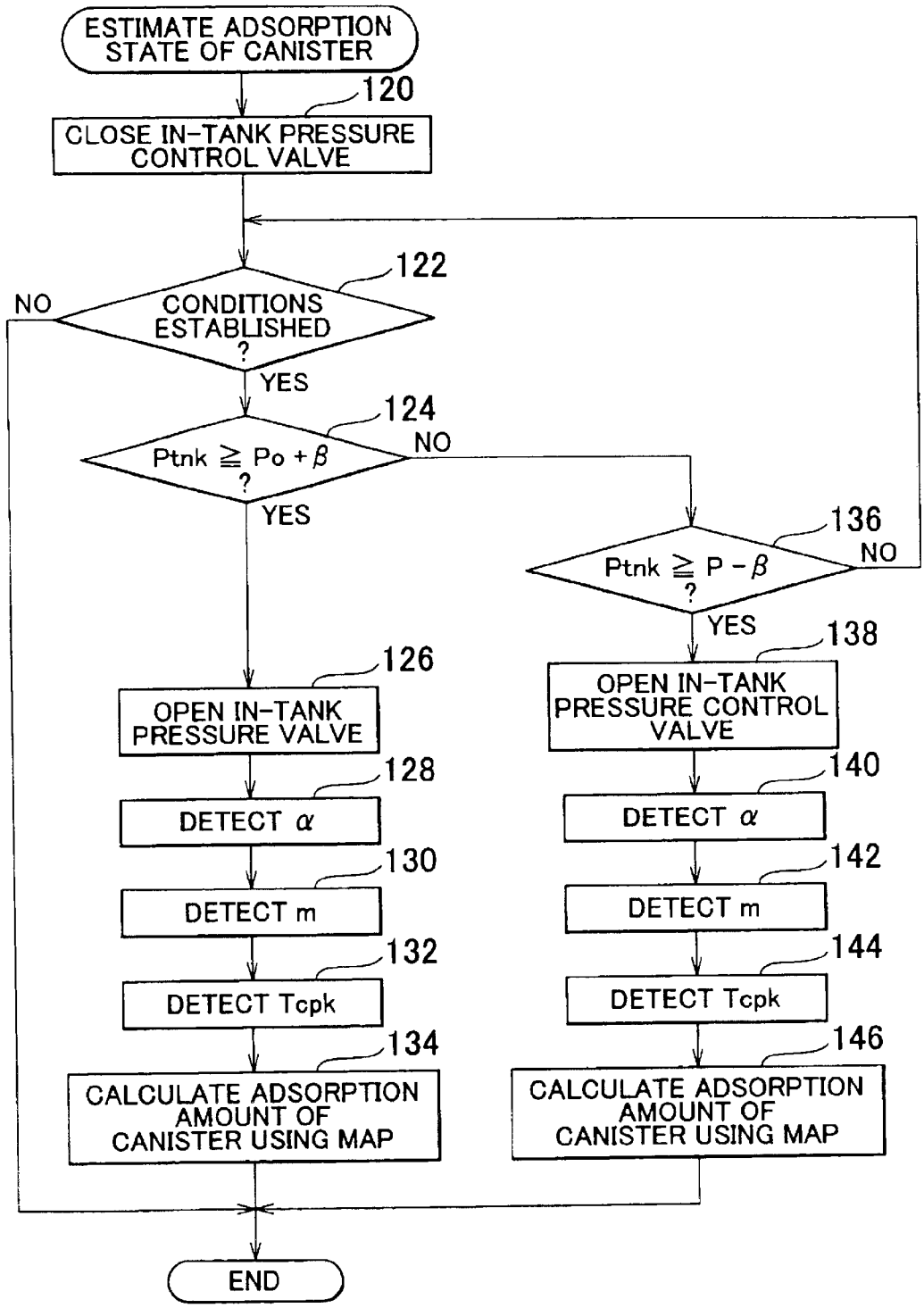
FIG. 8 is a flowchart of a control routine executed according to the second embodiment.

FIG. 8 is a flowchart of the control routine executed by the ECU 40 for realizing the aforementioned function. The control routine shown in FIG. 8 is executed under the condition where purge is not performed irrespective of ON/OFF condition of the ignition switch.

Referring to the control routine shown in the flowchart of FIG. 8, in step 120, the in-tank pressure control valve 52 is closed. When the in-tank pressure control valve 52 is closed, the fuel tank 10 and the canister 20 are disconnected. As the inner space of the canister 20 is opened to the atmosphere, the inner pressure of the canister 20 is, thus, generally held in the atmospheric pressure Po. The inner pressure of the fuel tank 10 increases resulting from vaporization of the fuel vapor after closing of the in-tank pressure control valve 52, and then drops resulting from liquefaction thereof. After execution of step 120, a relatively high differential pressure is generated between the fuel tank side and the canister side with respect to the in-tank pressure control valve 52.

In the control routine shown in FIG. 8, in step 122, it is determined whether the condition for estimating the fuel adsorbing state is established. More specifically, in step 122, it is determined whether the tank temperature sensor 16, the in-tank pressure sensor 50, and the canister temperature sensor 84 are operated correctly. If those sensors are correctly operated, it is determined that the conditions are established. If those sensors are not correctly operated, it is determined that the conditions are not established.

In step 122, if No is obtained, that is, the conditions for estimating the fuel adsorbing state are not met, the control routine ends. If Yes is obtained, that is, the conditions are met, the process proceeds to step 124 where it is determined whether the in-tank pressure Ptnk is equal to or higher than a predetermined reference value Po+β, that is, the in-tank pressure Ptnk is higher than the inner pressure (atmospheric pressure Po) of the canister 20 by a predetermined value β.

If Yes is obtained in step 124, that is, Ptnk≧Po+β, it is determined that the pressure at the fuel tank side is higher than that of the canister side, that is, high differential pressure is generated in the passage between the fuel tank side and the canister side with respect to the in-tank pressure control valve 52. Then the process proceeds to step 126 where the in-tank pressure control valve 52 is opened.

When the in-tank pressure control valve 52 is opened in step 126, the differential pressure causes a large quantity of gas to flow from the fuel tank 10 into the canister 20. As a result, the fuel at least in the vicinity of the purge port 28 is adsorbed in the active carbon 30 until it is saturated. Then the ECU 40 serves to estimate the fuel adsorbing state of the canister 20 on the basis of the fuel vapor concentration α of the gas flowing into the canister 20, the flow rate m of the gas flowing into the canister 20, and the canister peak temperature Tcpk generated as the gas flows into the canister 20.

In step 128, the fuel vapor concentration α of the gas flowing from the fuel tank 10 to the canister 20 is detected. In step 130, the flow rate m (g/min) of the gas flowing into the canister 20 is detected. In step 132, the canister peak temperature Tcpk generated during the flow of the gas into the canister 20 is detected.

The ECU 40 stores the map as shown in FIG. 6, that is, the three dimensional map in which the quantity of the fuel adsorbed in the canister 20 is defined by the fuel vapor concentration α, the gas flow rate m, and the canister peak temperature Tcpk. Like step 114 of the first embodiment, in step 134, the ECU 40 refers to the map with respect to the fuel vapor concentration α, the gas flow rate m, and the canister peak temperature Tcpk detected in steps 128 to 132 so as to estimate the fuel adsorbing state of the canister 20 in step 134.

In step 106 of the control routine of the first embodiment, the fuel vapor concentration is obtained under the condition where the fuel is supplied, that is, the in-tank pressure Ptnk is regarded as being equal to the atmospheric pressure Po. Meanwhile, in the second embodiment, the fuel vapor concentration has to be obtained under the condition where the in-tank pressure Ptank cannot be regarded as being equal to the atmospheric pressure (see step 128 of the control routine shown in FIG. 8). Therefore, step 128 cannot be executed in the same manner as in step 106 of the control routine as shown in FIG. 2.

Also in step 110 of the control routine according to the first embodiment, the gas flow rate m is obtained during the fuel supply, that is, under the condition where the fluid level of the fuel tank 10 is rising. The gas flow rate m can be obtained on the basis of the change in the fluid level in accordance with an elapse of time. In the second embodiment, however, the gas flow rate m has to be obtained under the condition where no change in the fluid level occurs in spite of an elapse of time. The process executed in step 130 as in the second embodiment, therefore, cannot be executed in the same manner as in the first embodiment.

The process to be executed in steps 128 and 130 will be described in detail later referring to FIGS. 9 to 11. The description of the control routine shown in FIG. 8 will be continued.

If No is obtained in step 124 of the control routine shown in FIG. 8, that is, the condition where Ptnk≧Po+β is not met, the process proceeds to step 136. In step 136, it is determined whether the in-tank pressure Ptnk is equal to or lower than the value of Po+β, that is, whether the in-tank pressure Ptnk is lower than the inner pressure of the canister 20 (atmospheric pressure Po) by at least β.

If No is obtained in step 136, that is, the condition where Pink≦Po−β is not met, it can be determined that there is no differential pressure between the fuel tank side and the canister side with respect to the in-tank pressure control valve 52, that is high enough to cause the flow of a large quantity of gas. The process in step 122 and subsequent steps will be repeatedly executed until the differential pressure generated as described above is detected.

If Yes is obtained in step 136, that is, the condition where Ptnk≦P−β is met, it can be determined that the pressure at the fuel tank side is lower than that at the canister side, that is, the differential pressure is generated therebetween. The process then proceeds to step 138.

When the in-tank pressure control valve 52 is opened in step 138, the differential pressure generated between the fuel tank side and the canister side causes a large quantity of gas to flow in the direction opposite to the flow upon the fuel supply, that is, from the canister 20 to the fuel tank 10. As a result, all the fuel adsorbed in the active carbon 30 around the purge port 28 is desorbed. The desorption of the adsorbed fuel from the active carbon 30 causes the endothermic reaction. As a result, the canister temperature Tcan is decreased so long as the fuel is desorbed from the active carbon around the purge port 28. Then when almost all the fuel is desorbed from the active carbon 30 and the fuel desorption no longer occurs, the canister temperature Tcan begins rising under the heat generated through the flow of gas. In the evaporated fuel processing apparatus of this embodiment, the canister temperature Tcan reaches the lower peak temperature Tcpk at the time when almost all the fuel is desorbed from the active carbon 30 around the purge port 28.

Likewise the first embodiment or in steps 126 to 134 of the second embodiment, when the canister temperature Tcan reaches the lower canister peak temperature Tcpk, the ECU 40 estimates the fuel adsorbing state of the canister 20 on the basis of the fuel vapor concentration α of the gas flowing from the canister 20, the flow rate m of the gas flowing from the canister 20 to the fuel tank 10, and the canister peak temperature Tcpk generated along with the gas flow.

More specifically in step 140 of the control routine shown in FIG. 8, the fuel vapor concentration α of the gas flowing from the canister 20 to the fuel tank 10 is detected. Then in step 142, the flow rate m (g/min) of the gas flowing from the canister 20 to the fuel tank 10 is detected. In step 144, the canister peak temperature Tcpk generated along with the flow of the gas from the canister 20 is detected.

The absolute quantity of the fuel adsorbed in the active carbon 30 after almost all the fuel is desorbed as much as possible therefrom under a certain condition is uniquely defined by the canister peak temperature Tcpk obtained during the supply of a large quantity of gas, the fuel vapor concentration α of the gas, and the gas flow rate m (g/min) like the way for obtaining the absolute quantity of the fuel adsorbed in the active carbon 30 in the saturated state. In this embodiment, the ECU 40 stores a three-dimensional map representing the fuel adsorption quantity after release of the fuel from the canister 20 defined by the fuel vapor concentration α, the gas flow rate m, and the canister peak temperature Tcpk together with the map as shown in FIG. 6. The ECU 40 then estimates the fuel adsorbing state of the canister 20 in reference to the map in step 146 after detecting the fuel vapor concentration α, the gas flow rate m, and the canister peak temperature Tcpk in steps 140 to 144.

In step 106 of the control routine in the first embodiment, the fuel vapor concentration is obtained under the condition where the gas flows from the fuel tank 10 to the canister 20. On the contrary in step 140 of the control routine in the second embodiment, the fuel vapor concentration is obtained under the condition where the gas flows from the canister 20 to the fuel tank 10. The process in step 140, thus cannot be executed in the same manner as in the first embodiment.

In step 110 of the control routine in the first embodiment, the gas flow rate m is obtained during the fuel supply, that is, under the conditions where the gas flows form the fuel tank 10 to the canister 20, and the fluid level of the fuel tank 10 is rising. In the first embodiment, the gas flow rate m can be obtained on the basis of the change in the fluid level as an elapse of time. However in step 142 of the control routine in the second embodiment, the gas flow rate m has to be obtained under the conditions where the gas flows form the canister 20 to the fuel tank 10, and no change in the fluid level occurs irrespective of an elapse of time. The process in step 142, thus, cannot be executed in the same manner as in the first embodiment.

The process executed in steps 140 and 142 will be described in detail as well as the process in steps 128 and 130 referring to FIGS. 9A, 9B to 11A, 11B.

Procedure for Detecting the Fuel Vapor Concentration α

Figure 9A:
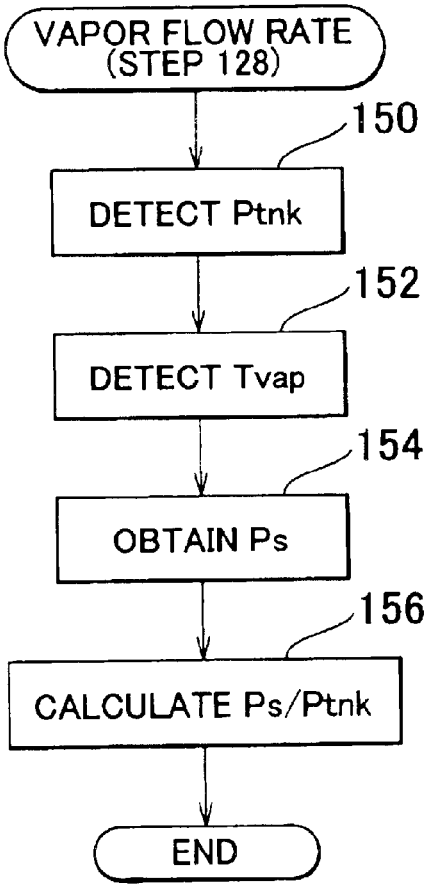
FIGS. 9A and 9B are flowcharts representing a series of processing for obtaining the fuel vapor concentration of the gas that flows between the fuel tank and the canister.

FIG. 9A is a flowchart of a series of processing executed in step 128 for detecting the fuel vapor concentration α under the condition where a large quantity of gas flows into the canister 20. In this case, the fuel vapor concentration α is detected by obtaining the saturated vapor pressure of the fuel contained in the gas flowing into the canister 20, and the ratio of the saturated vapor pressure to the gas pressure.

In step 150 of the flowchart in FIG. 9A, the in-tank pressure Ptnk is detected on the basis of an output of the in-tank pressure sensor 50. Then in step 152, the tank vapor temperature Tvap is detected on the basis of an output of the tank temperature sensor 16. The process proceeds to step 154 where the saturated vapor pressure Ps of the fuel vapor within the fuel tank 10 is obtained on the basis of the detected tank vapor temperature Tvap.

When the gas flows from the fuel tank 10 to the canister 20 after the in-tank pressure control valve 52 is opened, the saturated vapor pressure Ps of the gas is considered to be equal to the saturated vapor pressure Ps within the fuel tank 10. The pressure of the gas is considered to be equal to the in-tank pressure Ptnk. The fuel vapor concentration α of the gas can be obtained as the ratio of the saturated vapor pressure Ps to the in-tank pressure Ptnk, that is, Ps/Ptnk. Subsequent to step 154 of the flowchart of FIG. 9A, the fuel vapor concentration α is obtained through the equation α=Ps/Ptnk in step 156.

In the control routine of FIG. 9A, the fuel vapor concentration α can be appropriately obtained under the condition where the gas flows from the fuel tank 10 to the canister 20 after opening the in-tank pressure control valve 52.

Figure 9B:
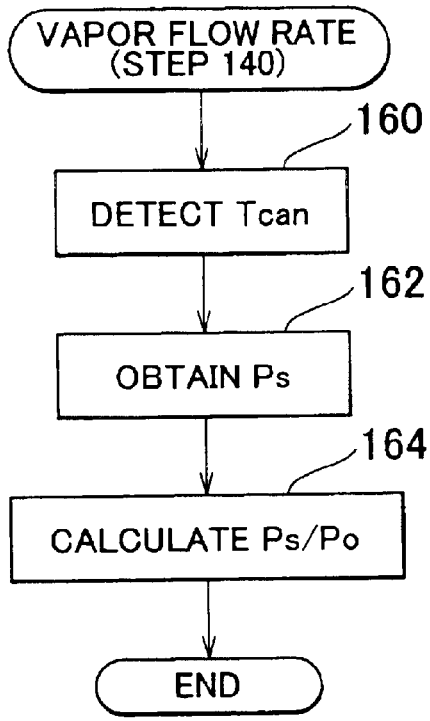

FIG. 9B is a flowchart of a series of processing executed in step 140 for detecting the fuel vapor concentration α under the condition where a large quantity of gas flows from the canister 20. In this case, the fuel vapor concentration α is detected by obtaining the saturated vapor pressure of the fuel contained in the gas flowing from the canister 20, and the ratio of the saturated vapor pressure to the gas pressure.

In step 160 of the flowchart in FIG. 9B, the canister temperature Tcan is detected on the basis of an output of the canister temperature sensor 34. Then in step 162, the saturated vapor pressure of the fuel vapor corresponding to the canister temperature Tcan is obtained. The thus obtained saturated vapor pressure is regarded as the saturated vapor pressure Ps of the fuel vapor within the canister 20.

The pressure of the gas that flows from the canister 20 to the fuel tank 10 after opening the in-tank pressure control valve 52 can be regarded as the inner pressure of the canister 20, that is, the atmospheric pressure Po. The fuel vapor concentration α of the gas can be obtained as the ratio of the saturated vapor pressure Ps to the atmospheric pressure Po. So in step 164 subsequent to step 162, the fuel vapor concentration α is obtained through the equation α=Ps/Po.

According to the control routine as shown in FIG. 9B, the fuel vapor concentration α of the gas that flows from the canister 20 to the fuel tank 10 after opening of the in-tank pressure control valve 52 can be appropriately obtained.

Procedure for Detecting Gas Flow Rate m

FIGS. 10A to 10D show how the flow rate m (g/min) of the gas flowing through the in-tank pressure control valve 52 is obtained in case the differential pressure is generated between the fuel tank side and the canister side with respect to the in-tank pressure control valve 52.

Figure 10A:
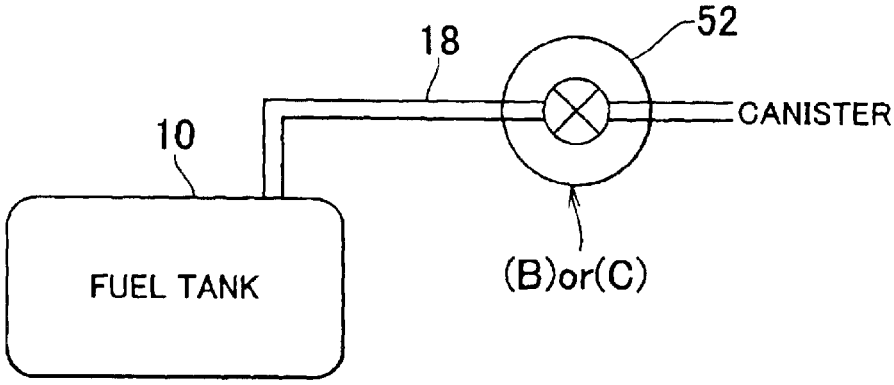
Figure 10B:
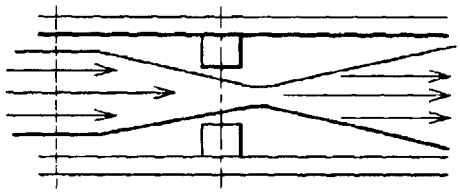
Figure 10C:
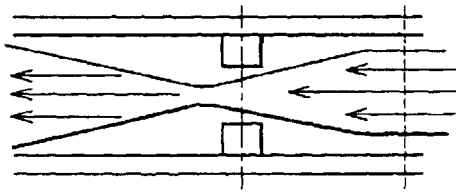

More specifically, FIG. 10A is a view of the evaporated fuel processing apparatus according to this embodiment, schematically showing the portion around the in-tank pressure control valve 52. FIGS. 10B and 10C are enlarged sectional views each showing a portion designated with B or C in FIG. 10A. FIG. 10B represents the state where the gas flows from the fuel tank 10 to the canister 20, and FIG. 10C represents the state where the gas flows from the canister 20 to the fuel tank 10. FIG. 10D shows a formula used for calculating the flow rate m of the gas.

In the case where the in-tank pressure control valve 52 is opened, and the differential pressure between the fuel tank side and the canister side with respect to the in-tank pressure control valve 52 is generated, the gas is caused to flow owing to the differential pressure. If the pressure at the fuel tank side is higher than that at the canister side, the gas is caused to flow from the fuel tank 10 to the canister 20 as shown in FIG. 10B. Assuming that the pressure at the fuel tank side is Pout, the pressure at the canister side is Pin, and the temperature at the canister side is Tin, the flow rate (g/min) is obtained by the following formula: Formula $$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Cd represents the flow rate coefficient (compressibility), r represents specific heat ratio, R represents gas constant, and Aval represents the opening area of the in-tank pressure control valve, respectively.

If the pressure at the canister side is higher than that at the fuel tank side, the gas flows from the canister 20 to the fuel tank 10 as shown in FIG. 10C. Assuming that the pressure at the canister side is Pout, the pressure at the fuel tank side is Pin, and the temperature at the fuel tank side is Tin, the flow rate (g/min) of the gas can be obtained by the above formula as well.

The pressure and the temperature to be substituted in the formula may be replaced by the values of the pressure and the temperature as follows. The pressure at the fuel tank side corresponds to the in-tank pressure Ptnk detected by the in-tank pressure sensor 50. The temperature at the fuel tank side corresponds to the tank vapor temperature Tvap detected by the tank temperature sensor 16. The pressure at the canister side 20 corresponds to the atmospheric pressure Po. The temperature at the canister side corresponds to the canister temperature Tcan detected by the canister temperature sensor 34. If the aforementioned values are substituted in the above formula, the flow rate of the gas that is caused to flow by the differential pressure between the fuel tank side and the canister side can be obtained by the ECU 40.

Figure 11A:
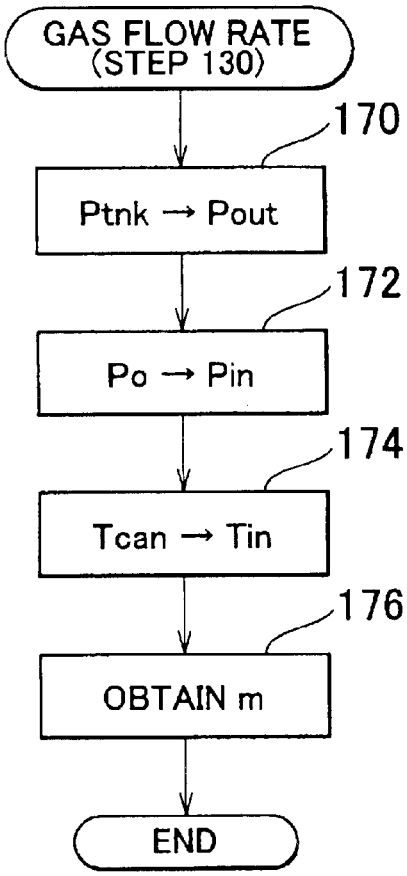
FIGS. 11A and 11B are flowcharts representing a series of processing for calculating the flow rate of the gas that flows between the fuel tank and the canister.

FIG. 11A is a flowchart of a routine for obtaining the flow rate m of the gas flowing from the fuel tank 10 to the canister 20, which is executed in step 130 as shown in FIG. 8.

In step 170 of the flowchart of FIG. 11A, the in-tank pressure Ptnk is stored as an outflow pressure Pout. Then in step 172, the pressure at the side of the canister 20, that is, the atmospheric pressure Po is stored as an inflow pressure Pin. In step 174, the canister temperature Tcan is stored as an inflow temperature Tin. Finally in step 176, the stored Pout, Pin and Tin are substituted in the formula so as to obtain the flow rate m (g/min) of the gas flowing towards the canister 20.

According to the routine of the flowchart of FIG. 11A, the flow rate m of the gas flowing from the fuel tank 10 to the canister 20 after opening the in-tank pressure control valve 52 may be appropriately obtained.

Figure 11B:
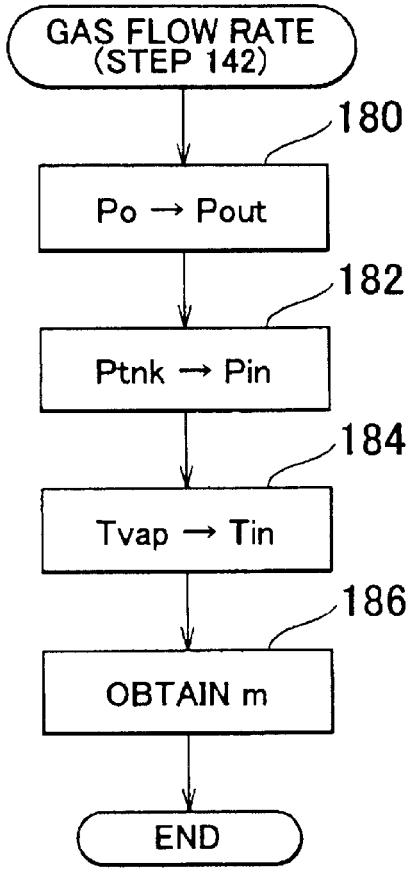

FIG. 11B is a flowchart of a routine for obtaining the flow rate m of the gas flowing from the canister 20 to the fuel tank 10, which is executed in step 142 as shown in FIG. 8.

In step 180 of the flowchart of FIG. 11B, the inner pressure of the canister 20, that is, the atmospheric pressure Po is stored as the outflow pressure Pout. Then in step 182, the in-tank pressure Ptnk is stored as the inflow pressure Pin. In step 184, the tank vapor temperature Tvap is stored as the inflow temperature Tin. Finally in step 186, the flow rate m (g/min) of the gas flowing from the canister 20 to the fuel tank 10 is obtained by substituting the stored Pout, Pin and Tin into the above formula.

According to the routine of the flowchart of FIG. 11B, the flow rate m of the gas flowing from the canister 20 to the fuel tank 10 after opening the in-tank pressure control valve can be appropriately obtained.

Modified Embodiment

In the second embodiment, the fuel adsorbing state of the canister 20 is estimated on the basis of the upper or lower canister peak temperature Tcpk. The fuel adsorbing state can be estimated on the basis of reference values other than the canister peak temperature Tcpk. For example, it may be estimated on the basis of the canister temperature Tcan obtained after the canister temperature Tcan reaches the peak temperature Tcpk in the course of flow of a large quantity of gas.

In the second embodiment, a large quantity of the gas flows between the fuel tank 10 and the canister 20 after opening the in-tank pressure control valve 52 owing to the differential pressure generated therebetween. Such differential pressure is detected by the in-tank pressure sensor 50. The ECU 40 executes step 126 or 138 such that the in-tank pressure control valve 52 is opened.

In the second embodiment, the ECU 40 executes step 152 such that the tank vapor temperature is detected, and step 154 such that the in-tank saturated vapor pressure is obtained. The ECU 40 further executes step 150 such that the in-tank pressure Ptnk is detected, and step 156 such that a first fuel vapor concentration is obtained.

In the second embodiment, the ECU 40 execute step 162 such that the saturated vapor pressure in the canister is obtained, and step 164 such that a second fuel vapor concentration is obtained.

In the second embodiment, the ECU 40 executes step 170 such that the in-tank pressure is obtained, and step 176 such that a first flow rate of the gas is obtained.

In the second embodiment, the ECU 40 executes step 184 such that the tank vapor temperature is detected, step 182 such that the in-tank pressure is obtained, and step 186 such that the second flow rate of the gas is obtained.

Third Embodiment

Structure and Characteristics of the Evaporated Fuel Processing Apparatus

Figure 12:
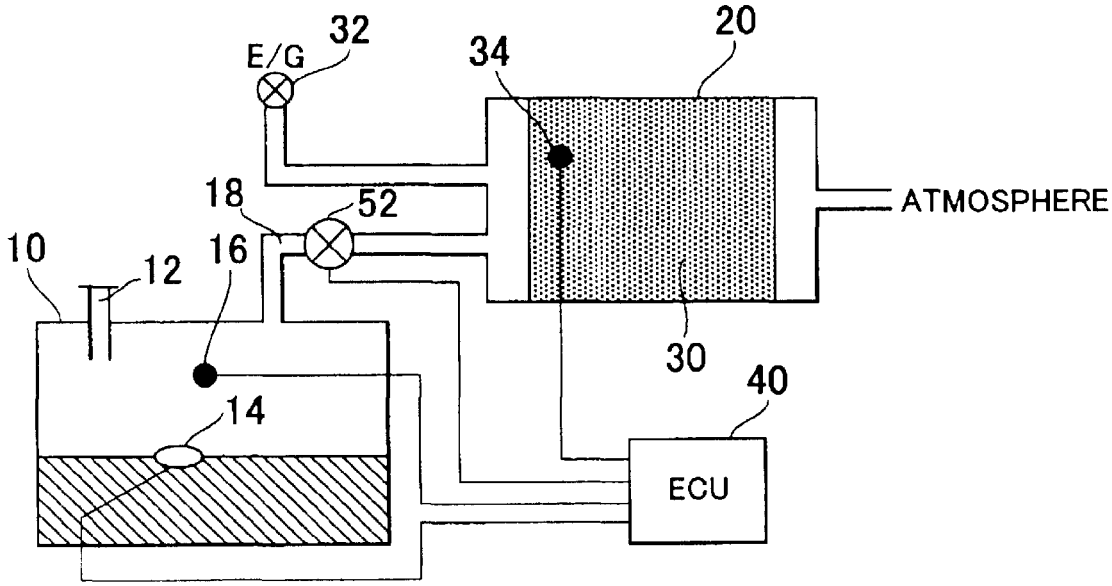
FIG. 12 is a schematic view of a fuel vapor processing apparatus according to a third embodiment.

A third embodiment of the invention will be described referring to FIGS. 12 and 13. FIG. 12 is a schematic view of the evaporated fuel processing apparatus of the invention. The portions of the fuel vapor processing apparatus of the third embodiment that are identical to those shown in FIG. 1 or FIG. 9 are designated with the same reference numerals. The description of those portions, thus, will be briefly described or omitted.

Referring to FIG. 12, the evaporated fuel processing apparatus of the third embodiment has substantially the same structure as that of the second embodiment shown in FIG. 7 except that a fluid level sensor 14 is provided inside of the fuel tank 10, and the tank temperature sensor 50 is removed from the fuel tank 10.

The evaporated fuel processing apparatus according to the second embodiment is structured to obtain the fuel vapor concentration $\alpha$ under the condition where the gas flows from the fuel tank 10 to the canister 20, or to obtain the flow rate m of the gas that flows between the fuel tank 10 and the canister 20 on the basis of the in-tank pressure Ptnk (see steps 156, 170 and 182). The in-tank pressure Ptnk is detected by the in-tank pressure sensor 50 provided in the fuel vapor processing apparatus.

The evaporated fuel processing apparatus of this embodiment is structured to estimate the in-tank pressure Ptnk in accordance of a tank model on the basis of an output of the fluid level sensor 14 so as to realize the function equivalent to that of the second embodiment.

Estimation of In-tank Pressure Ptnk

Figure 13:
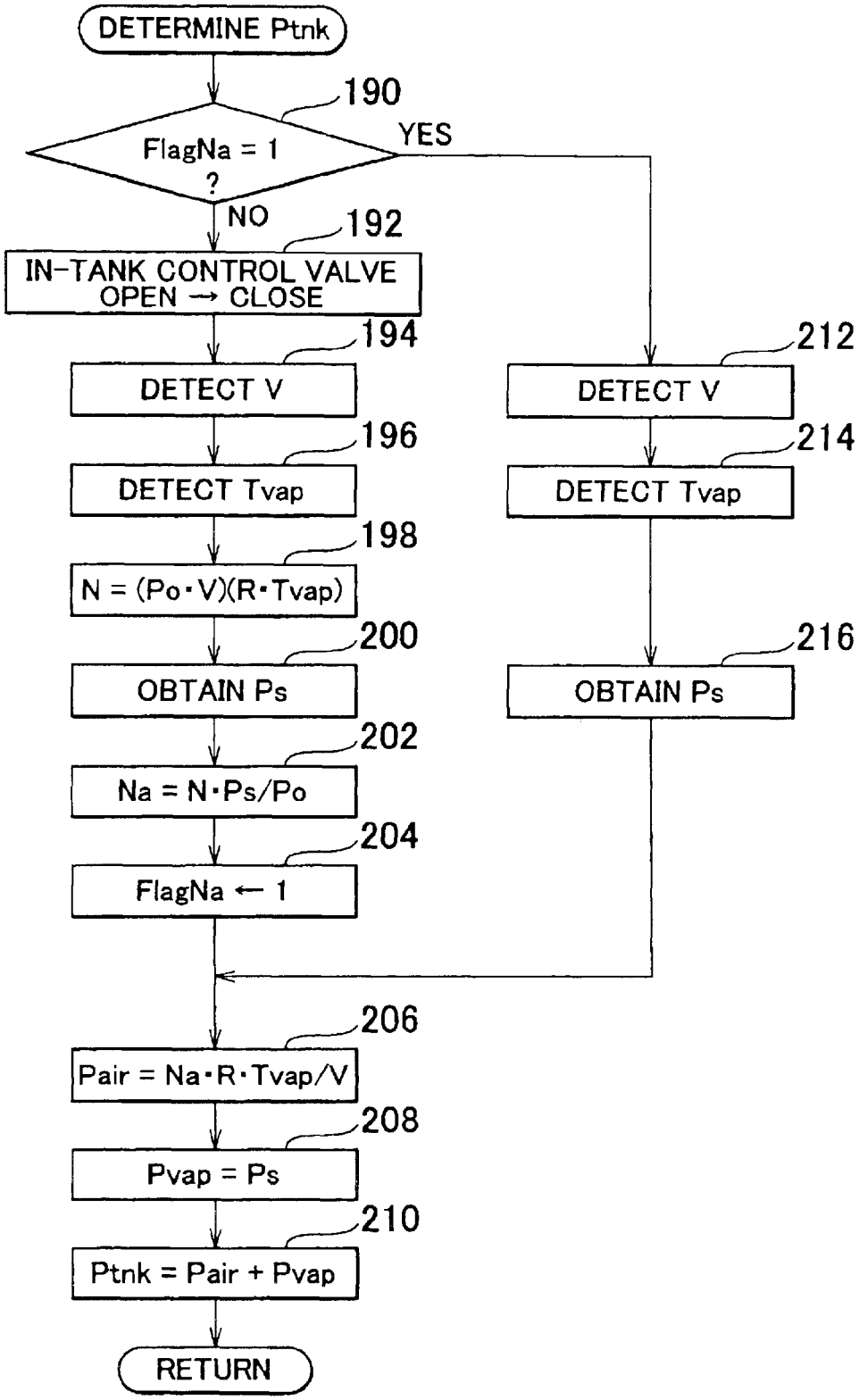
FIG. 13 is a flowchart of a control routine executed according to the third embodiment.

FIG. 13 shows a flowchart of the control routine executed by the ECU 40 for estimating the in-tank pressure Ptnk. In step 190 of the flowchart of FIG. 13, it is determined whether the flag FlagNA that indicates completion of calculating the number of moles of air has been set to 1.

If No is obtained in step 190, that is, FlagNa≠1, the process proceeds to step 192 where the in-tank pressure control valve 52 in the open state is closed. The in-tank pressure control valve 52 is held in the open state until execution of step 192, that is, the inside of the fuel tank 10 is opened to the atmospheric pressure Po. Immediately after execution of step 192, the in-tank pressure Ptnk is held at the pressure close to the atmospheric pressure Po even if the fuel tank 10 is disconnected from the canister 20.

Then in step 194, the space capacity V of the fuel tank 10 disconnected from the canister 20 is detected on the basis of the output of the fluid level sensor 14.

The process further proceeds to step 196 where the tank vapor temperature Tvap is detected on the basis of the output of the tank temperature sensor 16.

Immediately after closing the in-tank pressure control valve 52, that is, while the in-tank pressure Ptnk is held at the atmospheric pressure Po, the condition represented by the following equation is established within the space of the fuel tank 10:

$$Po \cdot V = N \cdot R \cdot Tvap$$

where N represents a total number of moles of the gas (air, fuel) contained in the fuel tank 10 that has been disconnected from the canister 20.

In step 198 of the control routine of FIG. 13, the total number of moles is obtained by the equation derived from modifying the aforementioned equation, that is, $$N=(Po\cdot V)/(R\cdot Tvap).$$

In step 200, the saturated vapor pressure Ps of the present fuel vapor under the environment where the in-tank pressure Ptnk is the atmospheric pressure Po is obtained on the basis of the tank vapor temperature Tvap detected in step 196.

Supposing that the total number of moles of the gas (air-fuel mixture) within the fuel tank 10 is N, the in-tank pressure Ptnk is the atmospheric pressure Po, and the partial pressure of the fuel is the saturated vapor pressure Ps, the number of moles of air Na can be obtained using the equation, that is, Na=N·Ps/Po. In step 202, the number of moles of air is obtained using the above equation on the aforementioned assumption.

The number of moles Na is held at the value calculated in step 202 so long as the in-tank pressure control valve 52 is closed, that is, the fuel tank 10 is disconnected from the canister 20. Subsequent to execution of step 202, the process proceeds to step 204 where the flag FlagNa is set to 1.

Supposing that the space capacity of the fuel tank 10 is V, the tank vapor temperature is Tvap, and the number of moles of air is Na, the air partial pressure Pair within the fuel tank 10 can be expressed by the equation, that is, Pair=Na·R·Tvap/V. In step 206 subsequent to step 204, the air partial pressure Pair within the fuel tank 10 is obtained using the above equation.

If the space capacity of the fuel tank 10 is saturated with the fuel, the fuel partial pressure Pvap becomes the fuel saturated vapor pressure Ps. On the aforementioned assumption, the fuel saturated vapor pressure Ps is set to be equal to the fuel partial pressure Pvap within the fuel tank 10 in step 208.

The pressure within the fuel tank 10 disconnected from the canister 20, that is, the in-tank pressure Ptnk is obtained by adding the air partial pressure Pai and the fuel partial pressure Pvap within the fuel tank 10. In step 210, the following equation is used to obtain the in-tank pressure Ptnk by adding those partial pressures, that is, $$P\text{tnk}=P\text{air}+P\text{vap}.$$

Upon completion of obtaining the number of moles Na to set the flag FlagNa to 1, the control routine shown in FIG. 13 starts again. In step 190 of this routine, Yes is obtained accordingly, that is, it is determined the equation FlagNa=1 is established. Subsequently, the space capacity V, and the tank vapor temperature Tvap are detected such that the saturated vapor pressure Ps is obtained on the basis of the tank vapor temperature Tvap (see steps 212, 214).

Upon completion of detection and calculation of the aforementioned values, step 206 and subsequent steps will be executed on the basis of the space capacity V, tank vapor temperature Tvap, and the saturated vapor pressure Ps.

In the state where the fuel tank 10 is disconnected from the canister 20 by closing the in-tank pressure control valve 52, the in-tank pressure Ptnk varies as the change in the space capacity V or in the generated quantity of the fuel vapor. The aforementioned change may be accurately obtained in step 206 so as to accurately estimate the in-tank pressure Ptnk. The fuel vapor processing apparatus of this embodiment is structured to realize the function which is the same as the second embodiment, that is, accurate estimation of the fuel adsorbing state of the canister 20 without using the in-tank pressure sensor 50.

In the third embodiment, the tank temperature sensor 16 is used to detect the tank vapor temperature Tvap. The tank vapor temperature Tvap can be detected using devices other than the tank temperature sensor 16. The tank vapor temperature Tvap may be obtained in consideration of the gain/loss of energy owing to thermal transmission between outside and inside of the fuel tank, and owing to inflow/outflow of the gas between the fuel tank 10 and the canister 20 on the basis of law of conservation of energy and mass.

More specifically, the tank vapor temperature Tvap may be estimated in the following procedure without using the tank temperature sensor 16. Supposing that the fuel tank 10 is disconnected from the canister 20, the increase/decrease in the energy of the fuel tank 10 may be detected in consideration of the gain/loss of energy owing to the thermal transmission between the outer space and the inner space of the fuel tank 10, and owing to the inflow/outflow of the gas between the fuel tank 10 and the canister 20.

If the change in the energy within the fuel tank 10 is detected, the change in the pressure within the fuel tank 10, that is, the change in the in-tank pressure Ptnk can be detected. If the change in the in-tank pressure Ptnk is detected, the in-tank pressure Ptnk can be obtained using the state equation of Ptnk·V=N·R·Tvap on the assumption of law of mass conservation (the total number of moles within the fuel tank 10 is constant). Calculation of the in-tank pressure Ptnk makes it possible to eliminate the tank temperature sensor 16. So the evaporated fuel processing apparatus can be structured with less sensors for realizing the required functions of the third embodiment.

In the third embodiment, the ECU 40 executes step 200 or 216 of the control routine shown in FIG. 13 so as to calculate the saturated vapor pressure in the fuel tank, and step 194 or 212 of the control routine so as to detect the space capacity of the fuel tank 10. The ECU 40 further executes step 192 to disconnect the fuel tank 10 from the canister 20, step 198 to calculate the total number of moles, step 202 to calculate the number of moles of air, step 206 to calculate the air partial pressure, and step 210 to calculate the in-tank pressure, respectively.

What is claimed is:

1. An evaporated fuel processing apparatus for an internal combustion engine, comprising:

a canister that adsorbs a fuel vapor generated within a fuel tank;

a gas flow detecting mechanism that detects a flow of gas at least at a predetermined flow rate between the fuel tank and the canister, the predetermined flow rate being higher than a flow rate of gas normally flowing between the fuel tank and the canister which are communicated with each other;

a canister temperature detector that detects a temperature of the canister; and a controller that:

detects one of an upper peak value and a lower peak value of the temperature of the canister caused in a continual state of the flow of gas at least at the predetermined flow rate detected by the gas flow detecting mechanism; and estimates a fuel adsorbing state within the canister on the basis of the canister temperature obtained subsequent to a detection of the one of the upper peak value and the lower peak value.

2. The evaporated fuel processing apparatus according to claim 1, wherein:

the canister includes a purge port communicated with an intake passage of the internal combustion engine; and the canister temperature detector comprises a canister temperature sensor disposed around the purge port such that a temperature within the canister is detected.

3. The evaporated fuel processing apparatus according to claim 2, wherein the controller obtains:

a fuel vapor concentration of the gas flowing between the fuel tank and the canister in the continual state of the flow of gas at least at the predetermined flow rate; and a flow rate of the gas flowing between the fuel tank and the canister in the continual state of the flow of gas at least at the predetermined flow rate; and the controller further estimates the fuel adsorbing state on the basis of the canister temperature obtained subsequent to the detection of the one of the upper peak value and the lower peak value, the fuel vapor concentration, and the flow rate of the gas.

4. The evaporated fuel processing apparatus according to claim 3, wherein the controller:

contains a map that stores the fuel adsorbing state within the canister defined by the canister temperature, the fuel vapor concentration, and the flow rate of the gas; and refers to the map so as to determine the fuel adsorbing state in accordance with the canister temperature obtained subsequent to the detection of the one of the upper peak value and the lower peak value, the fuel vapor concentration, and the flow rate of the gas.

5. The evaporated fuel processing apparatus according to claim 4, wherein the gas flow detecting mechanism detects a flow of gas containing fuel vapor at least at the predetermined flow rate from the fuel tank to the canister upon a fuel supply.

6. The evaporated fuel processing apparatus according to claim 5, further comprising a tank vapor temperature detector that detects a vapor temperature within the fuel tank, wherein the controller obtains a saturated vapor pressure of a fuel vapor within the fuel tank on the basis of the tank vapor temperature, and further obtains a concentration of the fuel vapor on the basis of a ratio of the saturated vapor pressure to an atmospheric pressure.

7. The evaporated fuel processing apparatus according to claim 6, further comprising a space capacity detector that detects a space capacity of the fuel tank, wherein the controller obtains a flow rate of the gas on the basis of a change in the space capacity as an elapse of time.

8. The evaporated fuel processing apparatus according to claim 4, further comprising an in-tank control valve that controls communication between the fuel tank and the canister, and a differential pressure detector that detects a differential pressure generated between a side of the fuel tank and a side of the canister with respect to the in-tank control valve in a closed state, wherein the controller serves to open the in-tank control valve when the detected differential pressure is at least a predetermined valve opening pressure such that the gas flows at least at the predetermined flow rate between the fuel tank and the canister.

9. The evaporated fuel processing apparatus according to claim 8, further comprising a tank vapor temperature detector that detects a vapor temperature within the fuel tank, wherein the controller obtains:

a saturated vapor pressure of a fuel vapor within the fuel tank on the basis of the tank vapor temperature;

an inner pressure of the fuel tank; and a first fuel vapor concentration on the basis of a ratio of the saturated vapor pressure to the inner pressure of the fuel tank when the gas flows at least at the predetermined flow rate from the fuel tank to the canister.

10. The evaporated fuel processing apparatus according to claim 9, wherein the controller obtains:

a saturated vapor pressure of the fuel vapor within the canister on the basis of the canister temperature; and a second fuel vapor concentration on the basis of a ratio of the saturated vapor pressure to an atmospheric pressure when the gas flows at least at the predetermined flow rate from the canister to the fuel tank.

11. The evaporated fuel processing apparatus according to claim 10, wherein the controller obtains:

the inner pressure of the fuel tank; and a first flow rate of the gas that flows at least at the predetermined flow rate from the fuel tank to the canister using a formula: Formula:

$$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Pout as a pressure at an outflow side represents the inner pressure of the fuel tank, Tin as a temperature at an inflow side represents the canister temperature, Pin as a pressure at the inflow side represents the atmospheric pressure, Cd represents a flow rate coefficient indicating compressibility, r represents a ratio of the specific heat, R represents a gas constant, and Aval represents an opening area of the in-tank control valve.

12. The evaporated fuel processing apparatus according to claim 11, wherein the controller obtains:

the tank vapor temperature within the fuel tank;

the inner pressure of the fuel tank; and a second flow rate of the gas that flows at least at the predetermined flow rate from the canister to the fuel tank using a formula: Formula:

$$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Pout as the pressure at the outflow side represents the atmospheric pressure, the Tin as the temperature at the inflow side represents the tank vapor temperature within the fuel tank, the Pin as the pressure at the inflow side represents the inner pressure of the fuel tank, Cd represents the flow rate coefficient indicating compressibility, r represents the ratio of the specific heat, R represents the gas constant, and Aval represents the opening area of the in-tank control valve.

13. The evaporated fuel processing apparatus according to claim 12, wherein the controller comprises an in-tank pressure sensor for detecting the inner pressure of the fuel tank.

14. The evaporated fuel processing apparatus according to claim 13, further comprising a space capacity detector that detects a space capacity of the fuel tank, wherein the controller:

obtains the saturated vapor pressure of the fuel vapor within the fuel tank on the basis of the tank vapor temperature;

serves to block the fuel tank by closing the in-tank pressure control valve after the inner pressure of the fuel tank becomes the atmospheric pressure; and obtains a total number of moles of the gas within the fuel tank on the basis of the space capacity, the vapor temperature, and the atmospheric pressure obtained when the fuel tank is blocked; a number of moles of air within the fuel tank on the basis of a ratio of the saturated vapor pressure to the atmospheric pressure and the total number of moles; a partial pressure of air within the fuel tank on the basis of the number of moles of air, the space capacity, and the vapor temperature obtained when a block state of the fuel tank is held; and an inner pressure of the fuel tank by adding the saturated vapor pressure to the partial pressure of air.

15. An evaporated fuel processing method for an internal combustion engine including a canister for adsorbing a fuel vapor generated within a fuel tank, the evaporated fuel processing method comprising:

detecting a flow of gas at least at a predetermined flow rate between the fuel tank and the canister, the predetermined flow rate being higher than a flow rate of gas normally flowing between the fuel tank and the canister which are communicated with each other;

detecting a temperature of the canister;

detecting one of an upper peak value and a lower peak value of the temperature of the canister caused in a continual a state of the flow of gas at least at the predetermined flow rate detected by the gas flow detecting mechanism; and estimating a fuel adsorbing state within the canister on the basis of the canister temperature obtained subsequent to a detection of the one of the upper peak value and the lower peak value.

16. The evaporated fuel processing method according to claim 15, wherein:

a fuel vapor concentration of the gas flowing between the fuel tank and the canister is obtained in the continual state of the flow of gas at least at the predetermined flow rate;

a flow rate of the gas flowing between the fuel tank and the canister is obtained in the continual state of the flow of gas at least at the predetermined flow rate; and the fuel adsorbing state is estimated on the basis of the canister temperature obtained subsequent to the detection of the one of the upper peak value and the lower peak value, the fuel vapor concentration, and the flow rate of the gas.

17. The evaporated fuel processing method according to claim 16, wherein a map that stores the fuel adsorbing state within the canister defined by the canister temperature, the fuel vapor concentration, and the flow rate of the gas is referred to determine the fuel adsorbing state in accordance with the canister temperature obtained subsequent to the detection of the one of the upper peak value and the lower peak value, the fuel vapor concentration, and the flow rate of the gas.

18. The evaporated fuel processing method according to claim 17, wherein a flow of gas containing fuel vapor at least at the predetermined flow rate from the fuel tank to the canister upon a fuel supply is detected.

19. The evaporated fuel processing method according to claim 18, wherein a vapor temperature within the fuel tank is detected, and a saturated vapor pressure of a fuel vapor within the fuel tank is obtained on the basis of the vapor temperature, and a concentration of the fuel vapor is further obtained on the basis of a ratio of the saturated vapor pressure to an atmospheric pressure.

20. The evaporated fuel processing method according to claim 19, wherein a space capacity of the fuel tank is detected, and a flow rate of the gas is obtained on the basis of a change in the space capacity as an elapse of time.

21. The evaporated fuel processing method according to claim 17, wherein communication between the fuel tank and the canister is controlled, a differential pressure generated between a side of the fuel tank and a side of the canister with respect to the in-tank control valve in a closed state is detected, and the in-tank control valve is opened when the detected differential pressure is at least a predetermined valve opening pressure such that the gas flows at least at the predetermined flow rate between the fuel tank and the canister.

22. The evaporated fuel processing method according to claim 21, wherein:

a vapor temperature within the fuel tank is detected;

a saturated vapor pressure of a fuel vapor within the fuel tank is obtained on the basis of the tank vapor temperature;

an inner pressure of the fuel tank is obtained; and a first fuel vapor concentration is obtained on the basis of a ratio of the saturated vapor pressure to the inner pressure of the fuel tank when the gas flows at least at the predetermined flow rate from the fuel tank to the canister.

23. The evaporated fuel processing method according to claim 22, wherein:

a saturated vapor pressure of the fuel vapor within the canister is obtained on the basis of the canister temperature; and a second fuel vapor concentration is obtained on the basis of a ratio of the saturated vapor pressure to an atmospheric pressure when the gas flows at least at the predetermined flow rate from the canister to the fuel tank.

24. The evaporated fuel processing method according to claim 23, wherein:

the inner pressure of the fuel tank is obtained; and a first flow rate of the gas that flows at least at the predetermined flow rate from the fuel tank to the canister is obtained using a formula: Formula:

$$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Pout as a pressure at an outflow side represents the inner pressure of the fuel tank, Tin as a temperature at an inflow side represents the canister temperature, Pin as a pressure at the inflow side represents the atmospheric pressure, Cd represents a flow rate coefficient indicating compressibility, r represents a ratio of the specific heat, R represents a gas constant, and Aval represents an opening area of the in-tank control valve.

25. The evaporated fuel processing method according to claim 24, wherein:

the tank vapor temperature within the fuel tank, the inner pressure of the fuel tank; and a second flow rate of the gas that flows at least at the predetermined flow rate from the canister to the fuel tank is obtained using a formula: Formula:

$$m = Cd\frac{Pin}{\sqrt{RTin}}Aval\left(\frac{Pout}{Pin}\right)^{\frac{1}{r}}\sqrt{\frac{2r}{r-1}\left\{1-\left(\frac{Pout}{Pin}\right)^{\frac{r-1}{r}}\right\}}$$

where Pout as the pressure at the outflow side represents the atmospheric pressure, the Tin as the temperature at the inflow side represents the tank vapor temperature within the fuel tank, the Pin as the pressure at the inflow side represents the inner pressure of the fuel tank, Cd represents the flow rate coefficient indicating compressibility, r represents the ratio of the specific heat, R represents the gas constant, and Aval represents the opening area of the in-tank control valve.

26. The evaporated fuel processing method according to claim 25, wherein:

a space capacity of the fuel tank is detected; the saturated vapor pressure of the fuel vapor within the fuel tank is obtained on the basis of the tank vapor temperature;

the fuel tank is blocked by closing the in-tank pressure control valve after the inner pressure of the fuel tank becomes the atmospheric pressure;

a total number of moles of the gas within the fuel tank is obtained on the basis of the space capacity, the vapor temperature, and the atmospheric pressure obtained when the fuel tank is blocked;

a number of moles of air within the fuel tank is obtained on the basis of a ratio of the saturated vapor pressure to the atmospheric pressure and the total number of moles;

a partial pressure of air within the fuel tank is obtained on the basis of the number of moles of air, the space capacity, and the vapor temperature obtained when a block state of the fuel tank is held; and an inner pressure of the fuel tank is obtained by adding the saturated vapor pressure to the partial pressure of air.

* * * * *